United States Patent [19]

Kay et al.

[11] Patent Number: 4,885,145

[45] Date of Patent: Dec. 5, 1989

[54] METHOD FOR PROVIDING OXYGEN ION VACANCIES IN LANTHANIDE OXIDES

[76] Inventors: D. Alan R. Kay, 4305 Lakeshore Rd., Burlington, Canada; William G. Wilson, 820 Harden Dr., Pittsburgh, Pa. 15229

[21] Appl. No.: 100,291

[22] Filed: Sep. 23, 1987

Related U.S. Application Data

[60] Continuation-in-part of Ser. No. 846,272, Mar. 31, 1986, Pat. No. 4,714,598, which is a division of Ser. No. 718,989, Apr. 2, 1985, Pat. No. 4,604,268, which is a continuation-in-part of Ser. No. 521,751, Aug. 8, 1983, Pat. No. 4,507,149, which is a continuation-in-part of Ser. No. 471,773, Mar. 3, 1983, which is a continuation of Ser. No. 174,024, Jul. 31, 1980, Pat. No. 4,397,683.

[51] Int. Cl.[4] ..... C01B 17/16; C01B 31/20; C01B 17/00; C01F 17/00

[52] U.S. Cl. ..... 423/230; 423/21.1; 423/244; 423/263; 502/303

[58] Field of Search ..... 423/21.1, 263, 244 A, 423/244 R, 242 A, 242 R, 230; 502/303

[56] References Cited

U.S. PATENT DOCUMENTS

| | | | |
|---|---|---|---|
| 1,912,455 | 6/1933 | Ingraham | 423/542 |
| 3,211,549 | 11/1965 | Kusaka | 75/134 |
| 3,784,374 | 1/1974 | Almand | 75/129 |
| 3,795,505 | 3/1974 | Corradini | 75/53 |
| 3,816,103 | 6/1974 | Link | 75/53 |
| 3,818,869 | 6/1974 | Blaskowski | 122/5 |
| 3,909,212 | 9/1975 | Schroeder | 44/1 R |
| 3,974,256 | 8/1976 | Wheelock | 423/230 |
| 4,002,720 | 1/1977 | Wheelock et al. | 423/230 |
| 4,018,597 | 4/1977 | Staggers | 75/58 |
| 4,140,655 | 2/1979 | Chabot et al. | 502/303 |
| 4,286,973 | 9/1981 | Hamlin | 55/92 |
| 4,290,805 | 9/1981 | Gorgerino | 75/120 R |
| 4,311,683 | 1/1982 | Hass et al. | 423/230 |
| 4,313,758 | 2/1982 | Henning | 75/130 R |
| 4,346,063 | 8/1982 | Cahn | 423/230 |
| 4,399,112 | 8/1983 | Voirin | 423/230 |
| 4,657,886 | 4/1987 | Kolts | 502/303 |

OTHER PUBLICATIONS

Moore, W. E., *Gas Stream Cleanup Program Overview, Proceedings of Sixth Annual Contractors Meeting on Contaminant Control In Coal-Derived Gas Streams,* DOE/-METC, 86/6042, Jul. 1986.

Coal Gasification Technology Report, DOE/METC, 87/0252, p. 31.

Zhen, Y. S., et al., *Oxygen Ion Conductivity of $La_2O_3$ Doped With Alkaline Earth Oxides,* Poster Session, World Congress on High Tech Ceramics, Milan, Italy, Jun. 1986.

Wang, D. Y. & A. S. Nowick, *Cathodic and Anodic Polarization Phenomena At Platinum Electrodes Doped With $CeO_2$ as Electrolyte,* J. Electrochemical Soc., Jul. 1979, pp. 12–13, 1157–1165.

Subbarao, B. & H. Maiti, *Solid Electrolytes With Oxygen Ion Conduction,* Solid State Ionics, 1984, pp. 317–338.

Kilner, J., *Fast Ion Transport In Solids,* Solid State Ionics, 1983, pp. 201–204.

Meng, V. V. M., *High Temperature Desulfurization Using Cerium Oxides and Bastnasite Concentrates,* Submitted to McMaster University, Oct. 1984.

F*A*C*T, Facility For The Analysis of Chemical Thermodynamics, Computing Center, McGill University, Montreal, Quebec, Canada.

(List continued on next page.)

*Primary Examiner*—Gregory A. Heller

*Attorney, Agent, or Firm*—Buchanan Ingersoll; Michael L. Dever

[57] ABSTRACT

A method for desulfurization of fuel gases resulting from the incomplete combustion of sulfur containing hydrocarbons whereby the gases are treated with lanthanide oxides containing large numbers of oxygen-ion vacancies providing ionic porosity which enhances the ability of the lanthanide oxides to react more rapidly and completely with the sulfur in the fuel gases whereby the sulfur in such gases is reduced to low levels suitable for fuels for firing into boilers of power plants generating electricity with steam turbine driven generators, gas turbines, fuel cells and precursors for liquid fuels such as methanol and the like.

18 Claims, 15 Drawing Sheets

OTHER PUBLICATIONS

Heyerichs, K., *The Effect Of Enhanced Ionic Conductivity and Temperature On The Reduction Kinetics Of Cerium Oxide,* Student Thesis, McMaster Univ., 1987.

Catlow, C. R. A., *Transport In Doped Fluorite Oxides,* Solid State Ionics, 81, 1983, pp. 201–207.

Marcilly, C. et al., *Preparation of Highly Dispersed Mixed Oxides and Oxide Solid Solutions By Pyrolysis Of Amorphous Organic Precursors,* J. Amer. Cer. Socl, vol. 53, #1, Jan. 1978, pp. 56–57.

Newby, R. A., *Laboratory Evaluation Of High–Temperature Sulfur Removal Sorbents For Direct Coal Fired Turbines,* Sixth Annual Contractors Meeting, pp. 78–87.

Houck, D. L., *Limestone Calcination And Sulfurization/-Desulfurization Of Lime,* Submitted Penn State University, Aug. 1979.

Grindly, T., *Analysis Of Fuel Gas Cleanup For Molton Carbonate Fuel Cells, The Effect Of Temperature And Pressure On The Regeneration Of Zinc Ferrite Desulfurization Sorbents,* Sixth Annual Contractors Meeting, pp. 190–212.

Smith, D. P., *Design Studies For Hot Gas Cleanup Systems In A Load Following Mode,* Seventh Annual Contractors Meeting, to be published.

Hot Gas Cleanup For Electric Power Generating, DOE/METC, 86/6038.

Smith, K. J., *KRW Process Development Coal Gasification Hot Gas Cleanup,* Seventh Annual Contractors Meeting.

Jha, M. G., *Enhanced Durability And Reactivity For Zinc Ferrite Desulfurization Sorbent,* Seventh Annual Contractors Meeting.

Klett, M. G. et al., *Process Systems And Economic Studies For High Temperature Desulfurization Process,* Sixth Annual Contractors Meeting, pp. 280–292.

Chang, R., *Study Of Ammonia Removal In Coal Gasification Processes Using An Integrated System Approach,* Seventh Annual Contractors Meeting.

METHOD FOR PROVIDING OXYGEN ION VACANCIES IN LANTHANIDE OXIDES

This application is a continuation-in-part of our copending application, Ser. No. 846,272, filed Mar. 31, 1986, now U.S. Pat. No. 4,714,598 which was a division of our application Ser. No. 718 989 filed Apr. 2, 1985 now U.S. Pat. No. 4,604,268, which was a continuation in part of our application Ser. No. 521,751 filed Aug. 8, 1983, now U.S. Pat. No. 4,507,149 which was a continuation-in-part of our application Ser. No. 471,773 filed Mar. 3, 1983, which was a continuation of our application Ser. No. 174,024 filed July 31, 1980 now U.S. Pat. No. 4,397,683.

This invention relates to the use of lanthanide oxides which contain large numbers of oxygen ion vacancies which provide ionic porosity that enhances the ability of the lanthanide oxides to react more rapidly and more completely with the sulfur in fuel gases resulting from the incomplete combustion of sulfur containing hydrocarbons at high temperature whereby the sulfur in such gases is reduced to low levels suitable for firing into the boilers of power plants generating electricity with steam turbine driven generators, fuels for gas turbines, fuel cells and as a precursor for liquid fuels such as methanol and the like.

The term "lanthanides" as used herein, includes the lanthanide "rare earth" elements having atomic numbers from 57 to 71, inclusive, and the element yttrium, atomic number 39, which is often found in rare earth concentrates and acts similarly to the other lanthanides in many respects.

The phrase "fuel gases" will be used hereinafter to describe gases produced by the incomplete combustion of sulfur containing hydrocarbons. The phrase "future requirements for fuel gases" will be used hereinafter to describe the fuel gases required for firing into the boilers of power plants generating electricity with steam turbine driven generators, the operation of gas turbines, fuel cells and precursors for the production of liquid fuels, such as methanol and the like, derived from solid hydrocarbons.

According to the ENERGY HANDBOOK published by Van Nordstrom and Reinhold there are 36.5 Quads (one Quad$=10^{18}$ Btu) of energy in the coal reserves of the United States as compared to 1.4 Quads in oil and 1.1 Quads in natural gas. The United States Department of Energy (DOE) has taken the lead in the development of methods to utilize this energy in coal in an ecologically and economically acceptable manner. The DOE has taken the initiative in this matter because industry in the United States has been reluctant to pursue this task, and an agency of the U.S. Government has been forced to take the lead just as was the case in the development of synthetic rubber and nuclear power.

There is a further necessity to develop methods for the utilization of coal because of the political instability in the Persian Gulf which is a major source of much of the world's oil, and the wide fluctuations in the price of crude oil in the last few years are clearly indicative of this instability.

Evidence continues to mount with regard to the detrimental effect of acid rain. Most of the effort to reduce the emission of sulfur from presently operating power plants using steam turbines for the generation of electricity have been concentrated on the removal of sulfur dioxide from the flue gases after the complete combustion of the coal which requires the installation of scrubbers between the boiler of such power plants and the smoke stack. The installation of a gasifier and desulfurization of the fuel gases produced prior to their complete combustion in the boiler would reduce the sulfur emissions from such plants several orders of magnitude lower than are obtainable with scrubbers. Sulfur removed in the form of elemental sulfur is possible, eliminating the problem of disposal of the sulfur containing compounds formed in the scrubbers, and the gases so produced could be burned with staged combustion to reduce the amount of nitrogen oxides one of the other components of flue gases contributing to acid rain.

At the Seventh Annual Gasification and Gas Stream Cleanup Systems Contractors Review Meeting sponsored by the Morgantown Energy Technical Center of the DOE held in June 1987 many of the requirements for coal-derived fuel gases for gas turbines, fuel cells and the production of liquid fuels from coal were described. Dr. James Corman, Manager of Thermochemical Processes Branch, General Electric Corp. stated that fuel gases for combined cycle gas turbines should contain less than 100 parts per million (ppm) of hydrogen sulfide $H_2S$), have a Btu value of at least 150 Btu from an air blown gasifier, and have as high a hydrogen content as possible to permit flame stability at low temperatures. At the present time control valves for the gas turbines are limited to an operating temperature of 1200° F./650° C., but there is a continuing search for better valves to permit the elevation of the fuel gas temperatures going into the gas turbine.

Specifications for fuel gases for fuel cells are more restrictive, requiring that the gases contain $H_2S$ contents no greater than 2 or 3 ppm. The present temperature specifications for fuel gases for fuel cells are not limited to a maximum of 1200° F., as is the case with gas turbines, but can go to higher temperatures if possible.

The catalyst used for the production of methanol from fuel gases are ordinarily very sensitive to sulfur. In a program sponsored by DOE, Mountain Fuel Resources has utilized a catalyst for the conversion of fuel gases to methanol that was less sensitive to sulfur than those previously used. However the exact level of sulfur that can be tolerated was not reported in the brief announcement available. It is likely that the lower the sulfur content of the fuel gases being used for the production of methanol, the better the process will perform over long periods of time. However, there will have to be some method of capture of the sulfur originally in the coal since it cannot be released into the atmosphere.

The major advantage of utilizing high temperatures for the gases exiting the gasifier which converts the coal to a gas is that as the gasifier operating temperature increases, the conversion of the coal to gas is more complete. If the gasifier operating temperature is 1800° F./982° C. the maximum conversion of the coal is approximately 94%, but if the gasifier operating temperature is raised to 2400° F./1315° C. the conversion of the coal increases to 97–98%. This increase in coal utilization over the life of a plant generating electricity can have a significant influence on the economics of the plant, and result in a significant reduction in the cost of electricity (COE) from such plants.

A term commonly used by chemical engineers to describe materials that react with the sulfur in fuel gases is the word "sorbent", which appears to be an all encompassing term that includes all of the methods whereby two materials become one. The methods whereby the two materials become one include: (1) chemical reaction between the two materials, (2) absorption of one material in another like water into a sponge, and (3) adsorption which is the attachment of a thin layer of one material on the other. This ill-defined term "sorbent" will be used hereinafter to describe the lanthanide oxides used for the desulfurization of fuel gases, but for this application the definition is related to (1) the chemical reaction of the lanthanide oxides and the sulfur in the fuel gases.

Since the basis of this application is the creation and the utilization of "oxygen ion vacancies" in the crystal lattice of the lanthanide oxides, it is necessary to describe one of the methods whereby these "oxygen ion vacancies" are formed. For this explanation cerium oxide, lanthanum oxide and magnesium oxide will be used, and the same combination of cerium and magnesium may be used hereafter to typify this phenomenon. The use of the oxides of cerium, lanthanum and magnesium in any of the illustrations or examples in no way precludes the use of any of the oxides of the other members of the lanthanide group of elements other than cerium nor does the use of the oxide of magnesium preclude the use of the oxides of any of the other members of the alkaline earth group of elements unless it is specifically noted as to the use of the specific members of the group of lanthanides or the group of alkaline earth elements.

The formation of oxygen ion vacancies in the crystal lattice of cerium oxide, the oxide of one of the lanthanide group of elements, by the addition of magnesium oxide, one of the oxides of the alkaline earth elements, may be explained as follows. The crystals of cerium oxide are composed of cerium oxide cations ($Ce^{+3}$ or $Ce^{+4}$) and oxygen anions ($O^{-2}$) distributed according to the crystal lattice specific for ceric oxide ($CeO_2$) and its sub-oxides. When one of the oxides of the alkaline earth elements such as MgO is in solution in the cerium oxide crystal, the cation ($Mg^{+2}$) substitutes for one of the cerium cations ($Ce^{+3}$ or $Ce^{+4}$). Since there can be no imbalance in electrical charges, the substitution of one $Mg^{+2}$ ion for one $Ce^{+4}$ ion, or two $Ce^{+3}$ ions, creates one $O^{-2}$ vacancy in the lattice.

Again using cerium oxide and magnesium oxide for illustration purposes, the cerium oxide without the magnesium oxide is like a checkerboard with a checker on each square, which immobilizes all the checkers except those at the edge. However an oxygen ion vacancy in the crystal lattice of the cerium oxide would be analogous to removing at least one checker from the checkerboard whereby all of the other checkers become more mobile. If the goal was to replace the checker in the exact center of the board, it would be much simpler if there were many vacancies on the board so that a new checker could be maneuvered into the center by moving the other checkers to make multiple paths to the center of the checkerboard.

When lanthanide oxide crystals contain small but significant quantities of one or more of the oxides of the alkaline earth elements or combinations of the same in solid solution such as to create oxygen ion vacancies, they are said to be "doped". The small but significant amount of the lanthanide oxide or alkaline earth oxide added to create the doped lanthanide oxide will hereinafter be referred to as the "dopant".

Cerium oxide, on of the lanthanide oxides, can be doped by the other lanthanide oxides, but cerium oxide is incapable of doping the other lanthanide oxides.

All dopants that have the same valence that form solid solutions with the lanthanide oxide being doped form equal numbers of oxygen ion vacancies, and they will be referred to hereinafter as "doped oxygen ion vacancies". The effectiveness of the dopant with regard to conductivity in solid electrolytes is a maximum when the ionic radius of the dopant is equal to the ionic radius of the lanthanide being doped. If the ionic radius of the dopant is different than the ionic radius of the lanthanide oxide being doped, there will be distortion of the crystal lattice, (the binding energy between the dopant cations and the oxygen ion vacancies will increase) and the ionic conductivity of the lanthanide oxide will be reduced. It is expected that the resistance to the entry of sulfur into the doped lanthanide crystals and the escape of the oxygen from the crystals will increase as distortion of the crystal lattice increases.

When cerous oxide is used for the desulfurization of fluid materials such as gases derived from the partial combustion of sulfur containing hydrocarbons wherein the sulfur in the fluid materials is mainly in the form of $H_2S$ the equation for the reaction may be written as follows:

$$Ce_2O_3+H_2S \rightarrow Ce_2O_2S+H_2O \quad (1)$$

In the reaction described in equation (1) there are two kinds of checkers (anions) that are moving in the crystal lattice. The anion of sulfur ($S^{-2}$) is moving into the lattice of the cerous oxide and the anion of oxygen ($O^{-2}$) is moving out. The ultimate goal of all desulfurization processes is to use as much of the desulfurizing agent as possible. That goal can best be achieved by increasing the ease of movement of the sulfur anions trying to get into the cerium oxide crystal lattice and by increasing the ease of movement of the oxygen anions out of the crystal lattice.

The most common form of cerium oxide is ceric oxide ($CeO_2$). The best form of cerium oxide for desulfurization is cerous oxide ($Ce_2O_3$). There is, however, a series of non-stoichiometric forms of cerium oxide intermediate between ceric oxide and cerous oxide. These non-stoichiometric forms of cerium oxide can be prepared by exposing ceric oxide to reducing gases such as hydrogen. When ceric oxide is converted to these non-stoichiometric forms, whose formula can be written as $CeO_{2-x}$ there is a loss of weight due to removal of oxygen from the crystal lattice (formation of oxygen vacancies). Oxygen ion vacancies created by exposure of cerium oxide to reducing gases will hereinafter be referred to as "reduction oxygen ion vacancies". Cerium oxide is no longer in the fluorite crystal habit when reduction of cerium oxide to an oxidation state lower than $CeO_{1.714}$ is achieved, and this is likely to result in the elimination of the reduction oxygen ion vacancies.

The concept of oxygen vacancies for purposes other than to enhance the performance of the lanthanide oxides for the desulfurization of fuel gases is not new. Other scientific desulfurization of fuel gases disciplines have frequently utilized oxygen ion vacancies for the production of electrical currents in solid electrolytes and for the transport of oxygen through solids containing oxygen ion vacancies. The latest application is the utilization of oxygen vacancies in a complex lanthanide-copper-strontium oxide crystals to achieve superconductivity in such crystals.

This invention relates to the use of all forms of oxygen ion vacancies in lanthanide oxides exposed to fuel gases to increase the conversion of the lanthanide oxide to the lanthanide oxysulfide thereby creating fuel gases suitable for future requirements for such gases.

The equation for the reaction between cerium oxide and $H_2S$ was shown previously (1). In order for the desulfurization of fuel gases with multivalent lanthanides to be a viable process, the lanthanide oxides must be converted as completely as possible to the lanthanide oxysulfide when exposed to fuel gases containing sulfur. This increase in conversion from the oxide to oxysulfides is generally referred to as "increasing the utilization". The term "utilization" will be used in this context throughout this application. It will be shown that there are a number of processes and procedures that increase utilization by increasing the number of oxygen ion vacancies in the crystal lattice of the lanthanide oxides.

This invention further relates to the method of increasing reduction oxygen ion vacancies in multivalent lanthanide oxides whereby the utilization is increased by the partial reduction of such oxides which is hereinafter referred to as "conditioning" according to the following equation:

$$CeO_2 + xH_2 \rightarrow CeO_{2-x} + xH_2O \quad (2)$$

Based on equation (2):

172 grams of $CeO_2$ loses 4.575 grams of oxygen when converted to $CeO_{1.714}$. $((2.0-1.714)\times 16=4.575$ gm)

1 gram of $CeO_2$ loses 0.0266 grams of oxygen when converted to $CeO_{1.714}$.

1 gram of $CeO_2$ loses 26.6 milligrams of oxygen when converted to $CeO_{1.714}$.

The oxygen removed from the cerium oxide would be in its ionic form whose chemical symbol is $O^{-2}$. One gram atomic weight of oxygen would contain $6.03\times 10^{23}$ oxygen atoms. Therefore, if the $CeO_2$ was reduced to $CeO_{1.714}$ there would be $(6.03\times 10^{23})/2\times 4.575/8=1724\times 10^{23}$ reduction oxygen ion vacancies in a gram molecular weight of $CeO_{1.714}$.

EXAMPLE 1

Complete conversion to $CeO_{1.714}$ $x=0.0266$ and 1 gram of $CeO_2$ loses 0.0266 grams i.e. Weight loss should be 26.6 milligrams $0.0266/16\times 6.03\times 10^{23}=1.00\times 10^{21}$ oxygen vacancies in one gram of $CeO_{1.714}$

EXAMPLE 2

1 gram of sorbent loses 7.33 milligrams in 60 minutes in 95% nitrogen, 5% hydrogen;

$93x=7.33$ and $x=0.079$ $CeO_2$ has been reduced to $CeO_{1.92}$ $0.00733/16\times 6.03\times 10^{23}=2.75\times 10^{20}$ reduction oxygen ion vacancies per gram.

EXAMPLE 3

0.2892 grams of 10% MgO doped $CeO_2$ sorbent at 970° C./1778° F. loses 4.25 milligrams in 48 minutes in 100% $H_2$ $93x=0.0425/0.2892$ and $x=0.158$ $CeO_2$ has been reduced to $CeO_{1.84}$ $0.00425/0.2892/16\times 6.03\times 10^{23}=5.54\times 10^{20}$ reduction oxygen ion vacancies per gram.

This invention further relates to the method of increasing the reduction oxygen ion vacancies in multivalent lanthanide oxides by preparation of the sorbents in a manner than decreases their bulk density which corresponds to an increase in microporosity whereby the utilization is increased when exposed to a reducing gas.

The conventional way to increase utilization is by increasing the surface area of the sorbent by decreasing the particle size of the particles or by plating the sorbent on an inert substrate which is commonly called a "support". The work performed under Small Business Innovation Research (SBIR) Phase I contract with the DOE, DE-ACO1-86ER80347, illustrates the effectiveness of the use of increased microporosity to increase the surface area of the sorbent to enhance the utilization of cerium oxide, one of the lanthanide oxides, for the removal of sulfur from fuel gases by increasing the number of oxygen ion vacancies.

In the work performed by Meng in partial fulfillment of the requirements for her doctorate degree entitled HIGH TEMPERATURE GASEOUS DESULFURIZATION USING CERIUM OXIDES AND BASTNASITE CONCENTRATES pellets of cerium oxide were prepared from optical grade cerium oxide by bonding the cerium oxide with starch solution and sintering the resultant material at 1250° C./2282° F. and 1400° C./2552° F. Some of these pellets which were sintered at 1250° C./2282° F. had a measured B.E.T. surface area of 0.45 $m^2$/gram. Experience gained under the SBIR/DOE contract would indicate a 1400° C./2552° F. sintering temperature would decrease the surface area compared to the pellets sintered at 1250° C./2282° F. The bulk density of the pellets sintered at 1400° C./2552° F. was computed to be 1.32 grams/cc. Originally these pellets were reduced with a mixture of 5% $H_2$ balance nitrogen for two to three hours. Examination of these pellets showed only a small area of their cross section which had been turned from the white color of the unreduced pellets to a light blue indicating some reduction. When the reduction time was increased to 24 hours, the pellets were a blue color throughout their cross section indicating reduction to $CeO_{2-x}$. When the these pellets reduced for two to three hours were exposed to a simulated fuel gas containing 33% $H_2$ with the remainder being a mixture of CO and $CO_2$ whose $CO/CO_2$ ratio was 5.10 there was instantaneous breakthrough to high $H_2S$ levels. However, when the pellets that had been reduced for twenty four hours were exposed to the same gas, there was no breakthrough for thirty minutes and there was utilization of 0.50%. Although Meng had speculated on the possibility of the formation of oxygen vacancies, she never the less attributed the very poor utilization to pore closure. "Experimentally, solid conversions less than 1.0% were obtained, suggesting that pore diffusion is very significant. This conclusion was confirmed by examination of reacted pellets which had been conditioned for twenty four hours which show a blue inner core of $Ce_{2-x}$ surrounded by a dark green outer layer." Meng restates this conclusion in the Summary and Conclusion of the thesis: "Low adsorption capacities (utilization) were obtained due to pore closure by $Ce_2O_2S$ and because of significant pore diffusion resistance. Capacities (utilization) can be increased by using a support." It was not recommended by some one skilled in the art that methods for increasing microporosity should be investigated to achieve higher utilization.

In the work performed under the DOE/SBIR contract B.E.T. surface areas were as high as 2.8 $m^2$/gram and the bulk densities ranged from 0.59 grams/cc to 0.33 grams/cc. When pellets with these characteristics were "conditioned" (exposed to a reducing gas containing 5% $H_2$ remainder nitrogen, the same as that used by Meng), the weight loss stabilized at about 7.33 mg when a 1.00 gram sample of the granules was exposed to the reducing gas for 60 minutes. These results are shown in FIG. 1. This degree of weight reduction corresponds to the conversion of $CeO_2$ to $Ce_{1.92}$, and this in turn suggests the formation of $2.75\times10^{20}$ reduction oxygen ion vacancies per gram in the crystal lattice of the cerium oxide so conditioned. (Calculation of oxygen vacancies in Example 2) FIG. 1 also shows that when a mixture of 60% CO and 40% $CO_2$ ($CO/CO_2$ ratio 1.5 whose partial pressure of oxygen at that temperature has been calculated to be $1.65\times10^{-19}$) is passed over the conditioned granules, the sample gains back 4.83 milligrams in about three minutes which represents much of the weight that was lost in the conditioning during the hour's exposure to the conditioning gas. The number of oxygen ion vacancies remaining can be calculated: 7.33 mg−4.83 mg/$(16\times1000)\times6.03\times10^{23}=9.42\times10^{19}$ reduction oxygen ion vacancies per gram remaining. The term "conditioned" will be used hereinafter to describe the results obtained by exposure of multivalent lanthanide oxides to reducing gases, a process which will hereinafter be referred to as "conditioning".

Because of the more porous structure of the granules made for exposure to fuel gases under the contract, the utilization has increased almost ten fold for desulfurization to less than 20 ppm $H_2S$ from 10000 ppm when compared to the results obtained by Meng. Using a reducing gas containing 33% $H_2$, remainder CO and $CO_2$ with a $CO/CO_2$ ratio of 6 whose partial pressure of oxygen was $4.64\times10^{-21}$, the utilization on one sulfidation test using these granules was 4.79% at a test temperature of 800° C./1472° F. When the test temperature was raised to 1000° C./1832° F. the utilization increased to 5.65%. The characteristics of the pellets produced under the SBIR/DOE contract can only be directly compared to the pellets produced by Meng on the basis of their bulk density (1.32 gm/cc for the pellets produced by Meng versus 0.59/0.33 gm/cc for the pellets produced under the contract). Photomicrographs show the pellets produced under the contract to have a high degree of microporosity. Furthermore, the weight loss in the TGA indicates the formation of substantial reduction oxygen ion vacancies whereas Meng had little indication of reduction of the pellets that were exposed for two to three hours to a reducing atmosphere. (Meng had to condition for twenty four hours to achieve only 0.50% utilization). The changes noted directly above between the Meng pellets and those produced under the SBIR/DOE contract explain the large increase in utilization of the sorbent achieved under the contract.

The drawings which illustrate the various changes which occur are as follows.

Figure 7A:
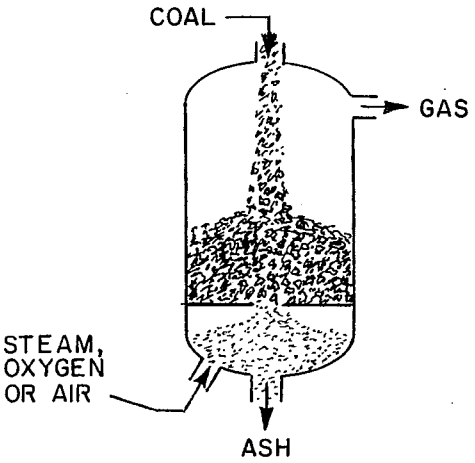

FIG. 7*a* is a schematic of a fixed-bed gasifier.

Figure 7B:
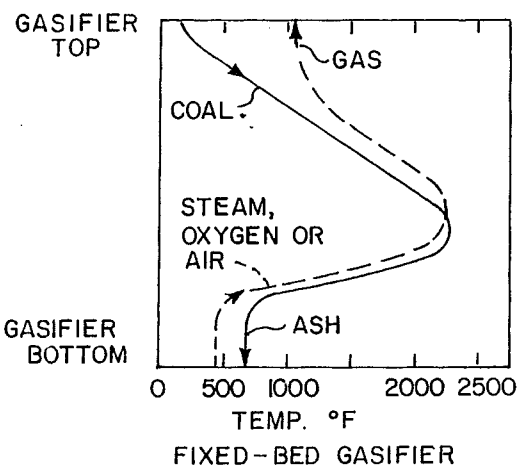

FIG. 7*b* is a graph of the temperatures of the coal and gas within the fixed-bed gasifier of FIG. 7*a*.

Figure 7C:
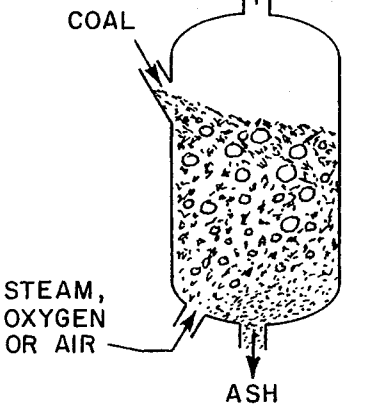

FIG. 7*c* is a schematic of a fluidized-bed gasifier.

Figure 7D:
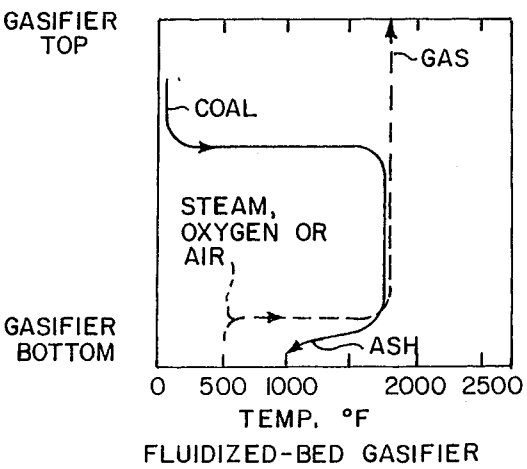

FIG. 7*d* is a graph of the temperatures of the coal and gas within the fluidized-bed gasifier of FIG. 7*c*.

Figure 7E:
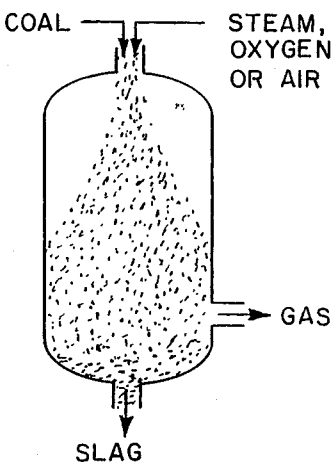

FIG. 7*e* is a schematic of a entrained-bed gasifier.

Figure 7F:
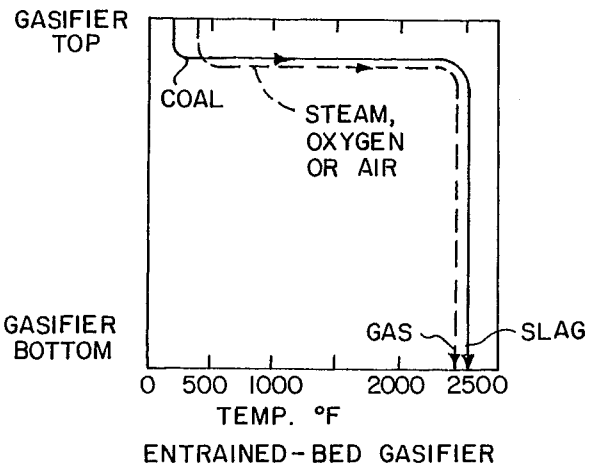

FIG. 7*f* is a graph of the temperatures of the coal and gas within the entrained-bed gasifier shown in FIG. 7*e*.

Figure 8:
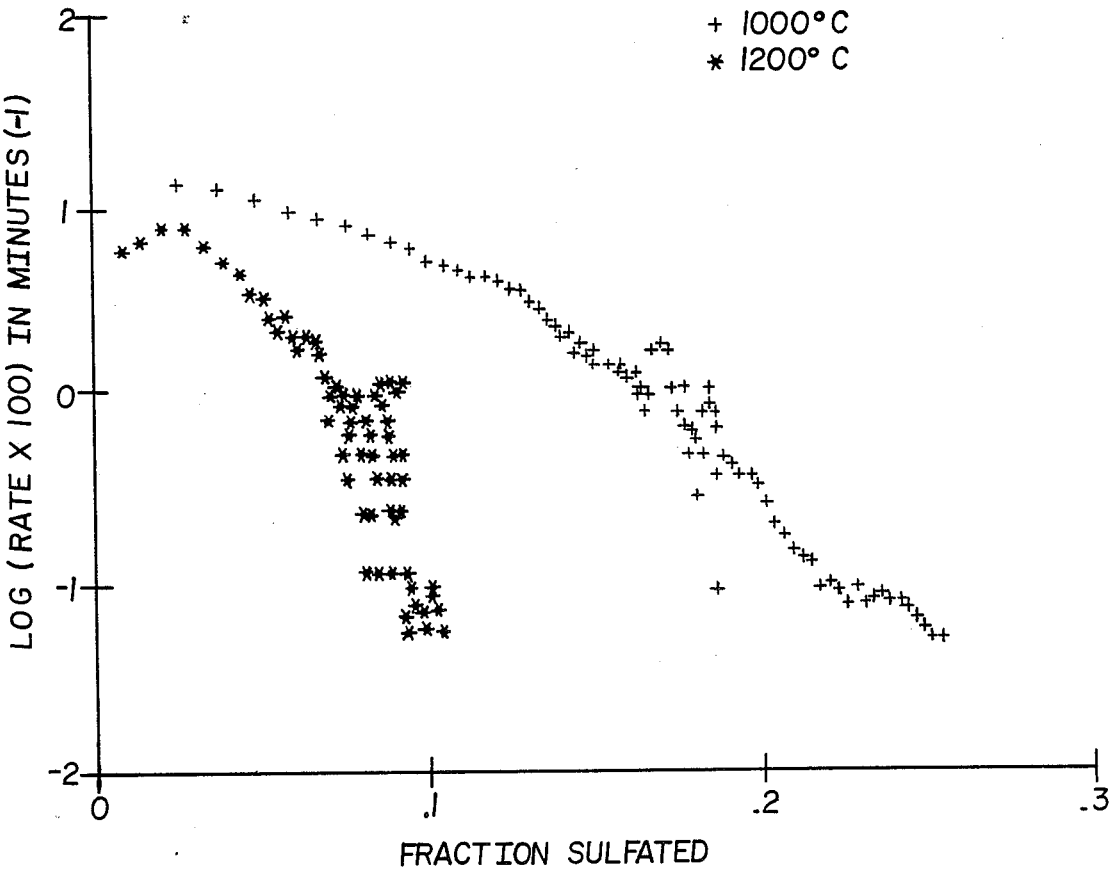

FIG. 8 is a plot of Effect of Temperature on the Rate of Desulfurization and the Fraction Sulfated (Utilization) of One Type of Limestone.

Figure 9:
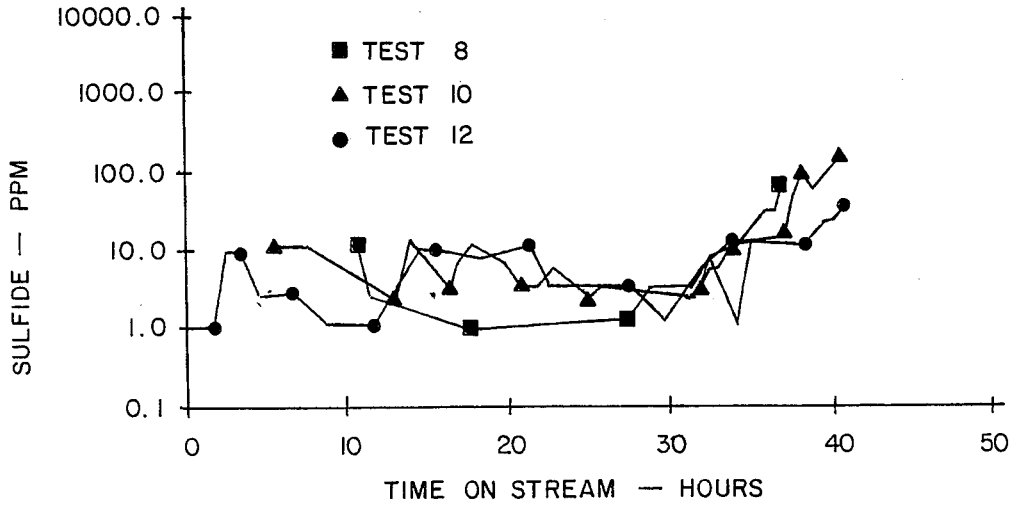

FIG. 9 is a plot of $H_2S$ Breakthrough Curves for Three Zinc Ferrite Tests.

Figure 10A:
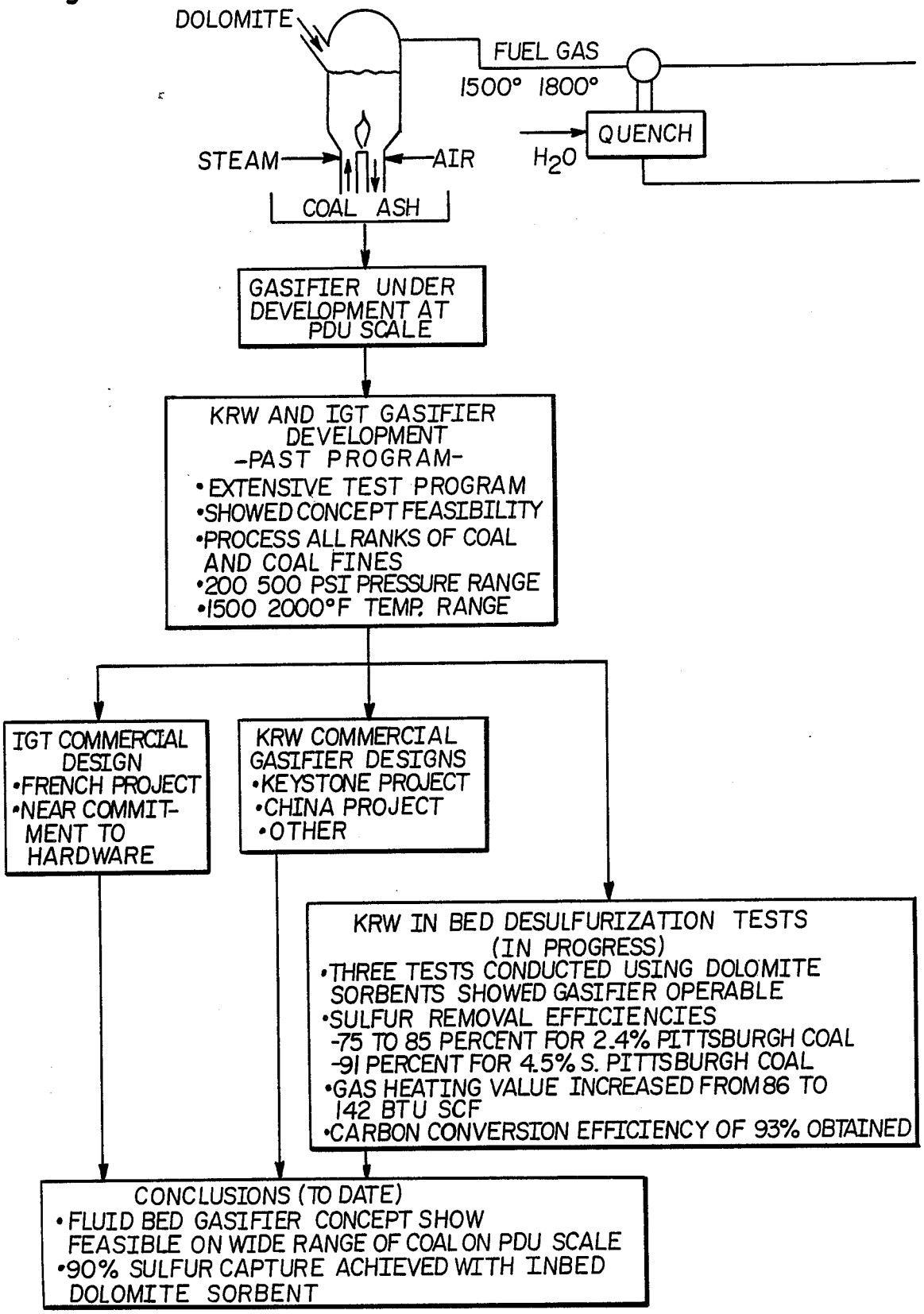
Figure 10B:
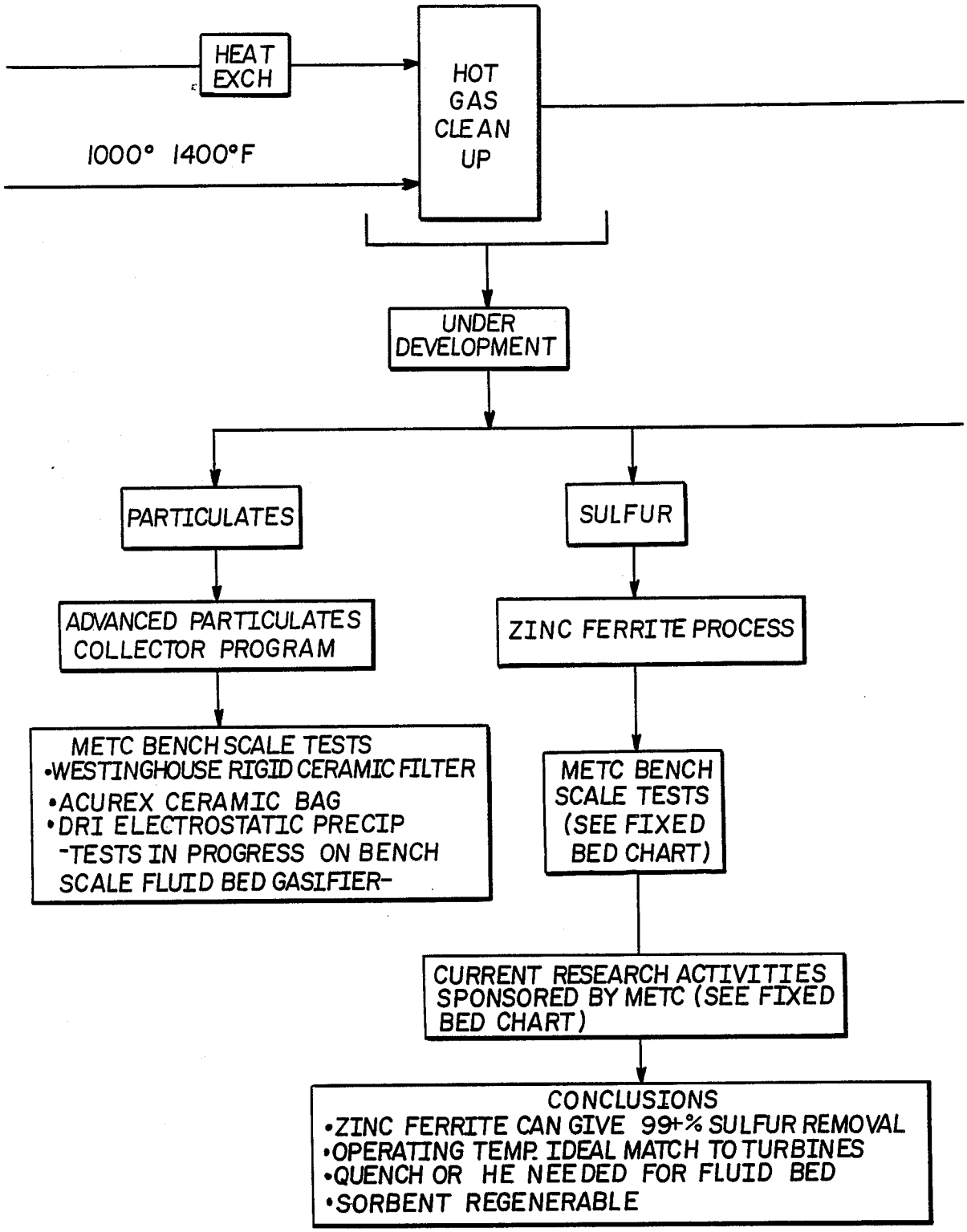
Figure 10C:
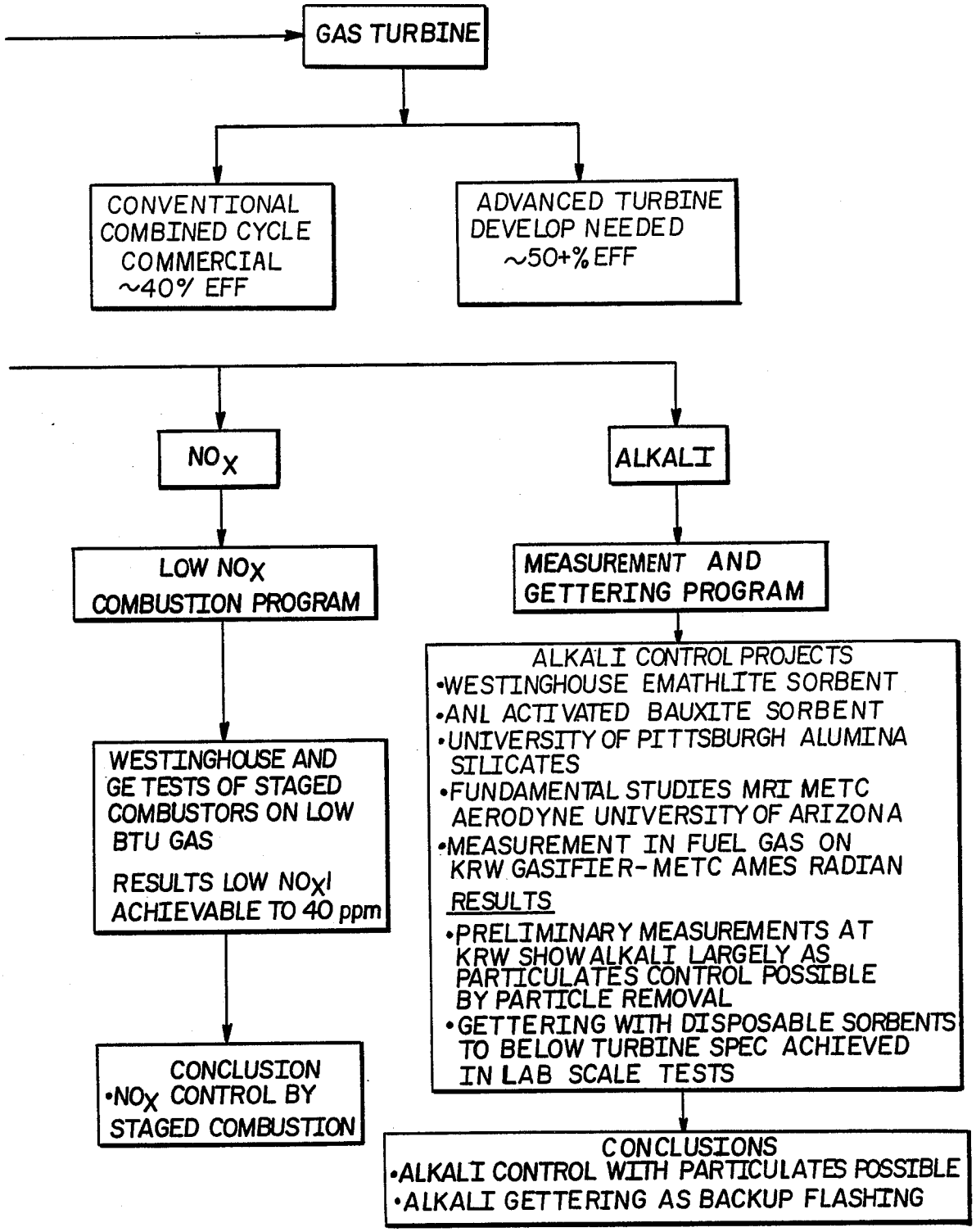

FIGS. 10*a*, 10*b*, and 10*c* are a Block Diagram of a Fluidized Bed Gasifier Combined Cycle Power Generation System.

Figure 11:
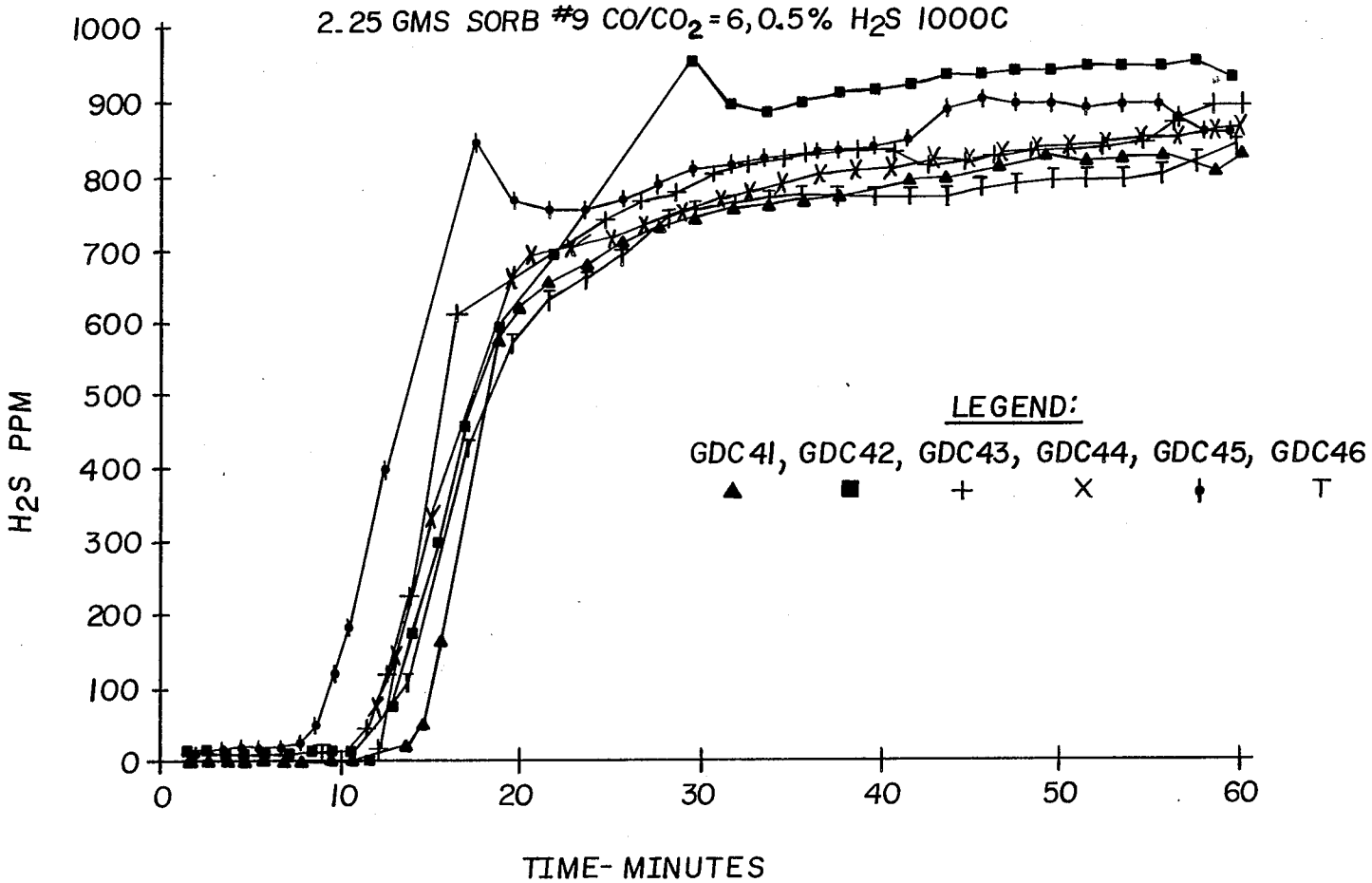

FIG. 11 is a plot of Six Successive Desulfurization Runs with 50% $N_2$, 33% $CO/CO_2=6$, 0.50% $H_2S$ and Remainder $H_2$.

Figure 12:
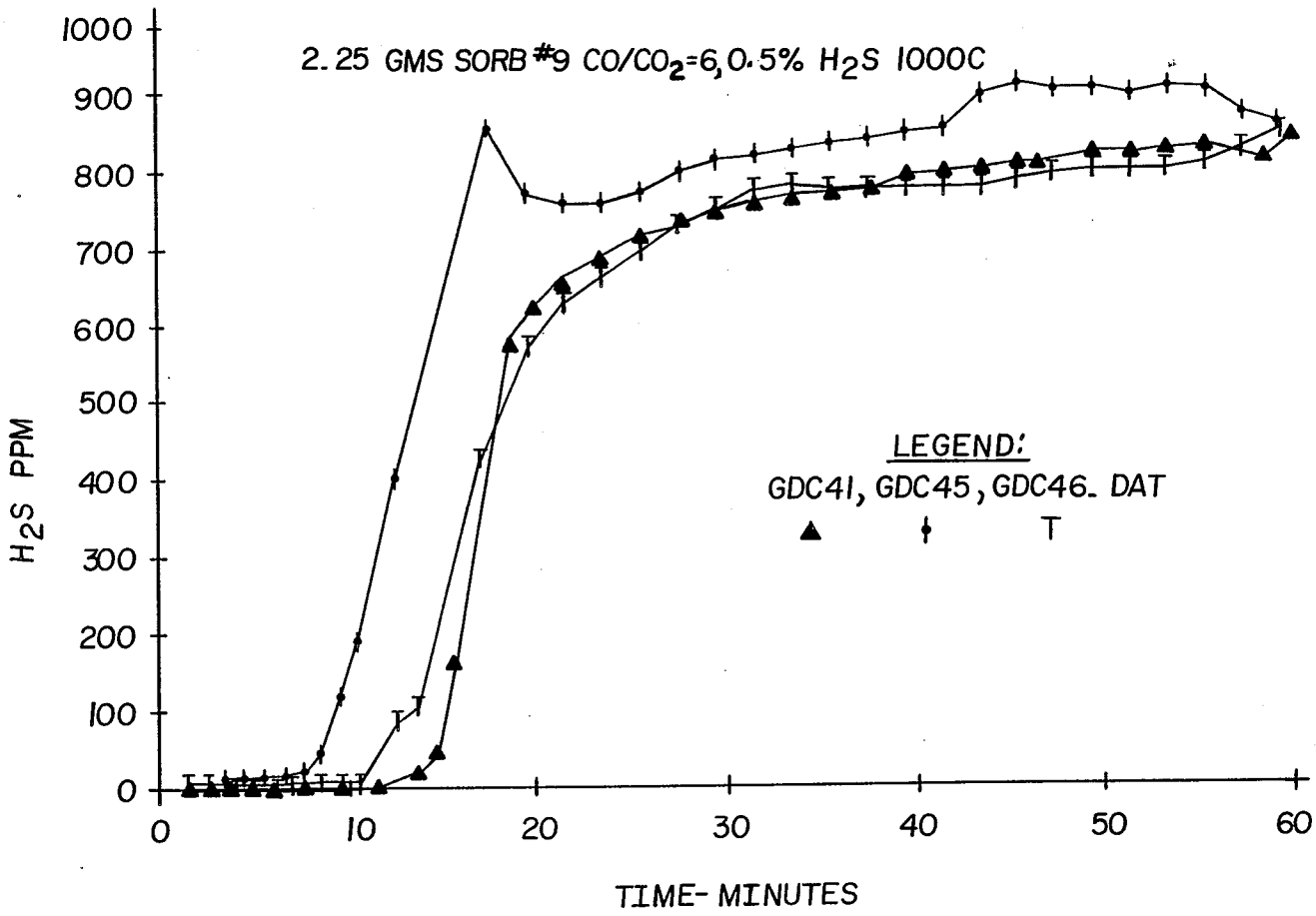

FIG. 12 is a plot of First, Fifth and Sixth Desulfurization Runs Selected from Those Shown in FIG. 11.

Figure 13:
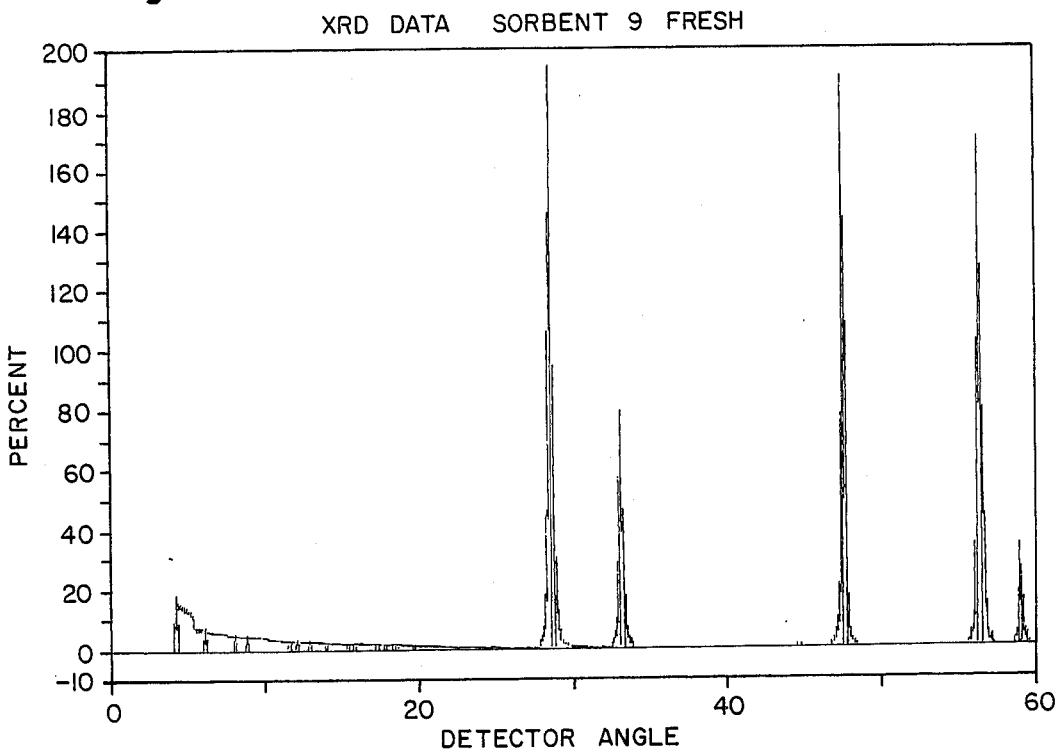

FIG. 13 is a plot of XRD Data from Sorbent #9 Prior to Its Use for Desulfurization.

Figure 14:
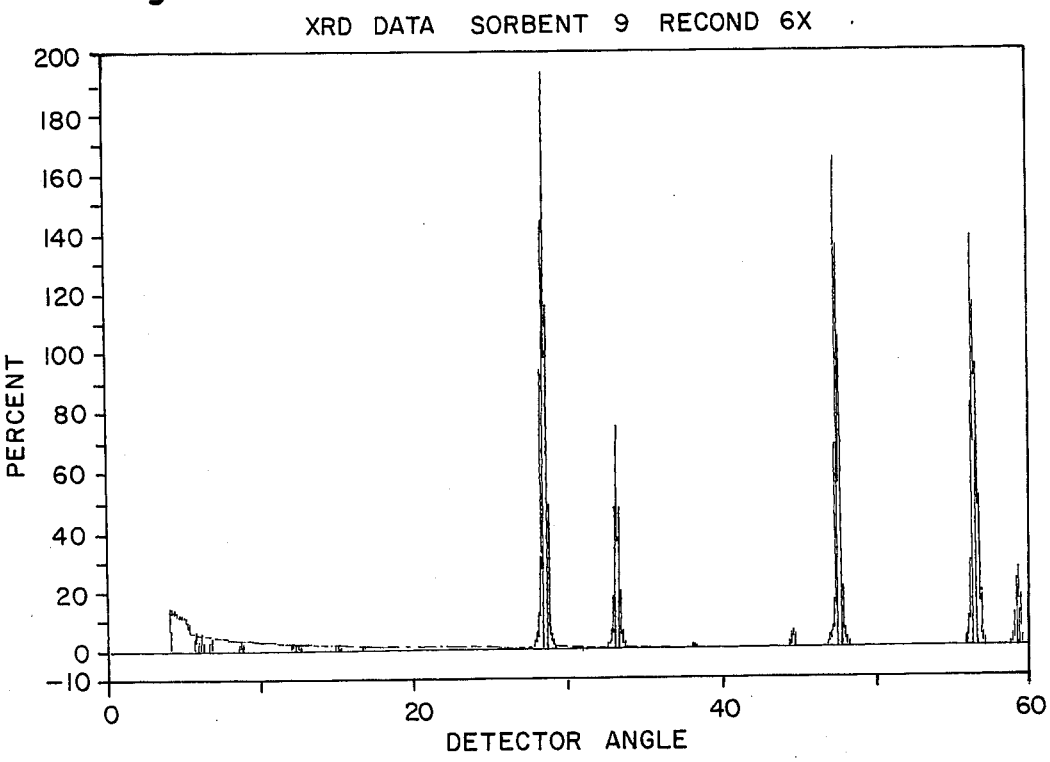

FIG. 14 is a plot of XRD Data from Sorbent #9 After Six Successive Cycles of Sulfidation and Regeneration.

Figure 15:
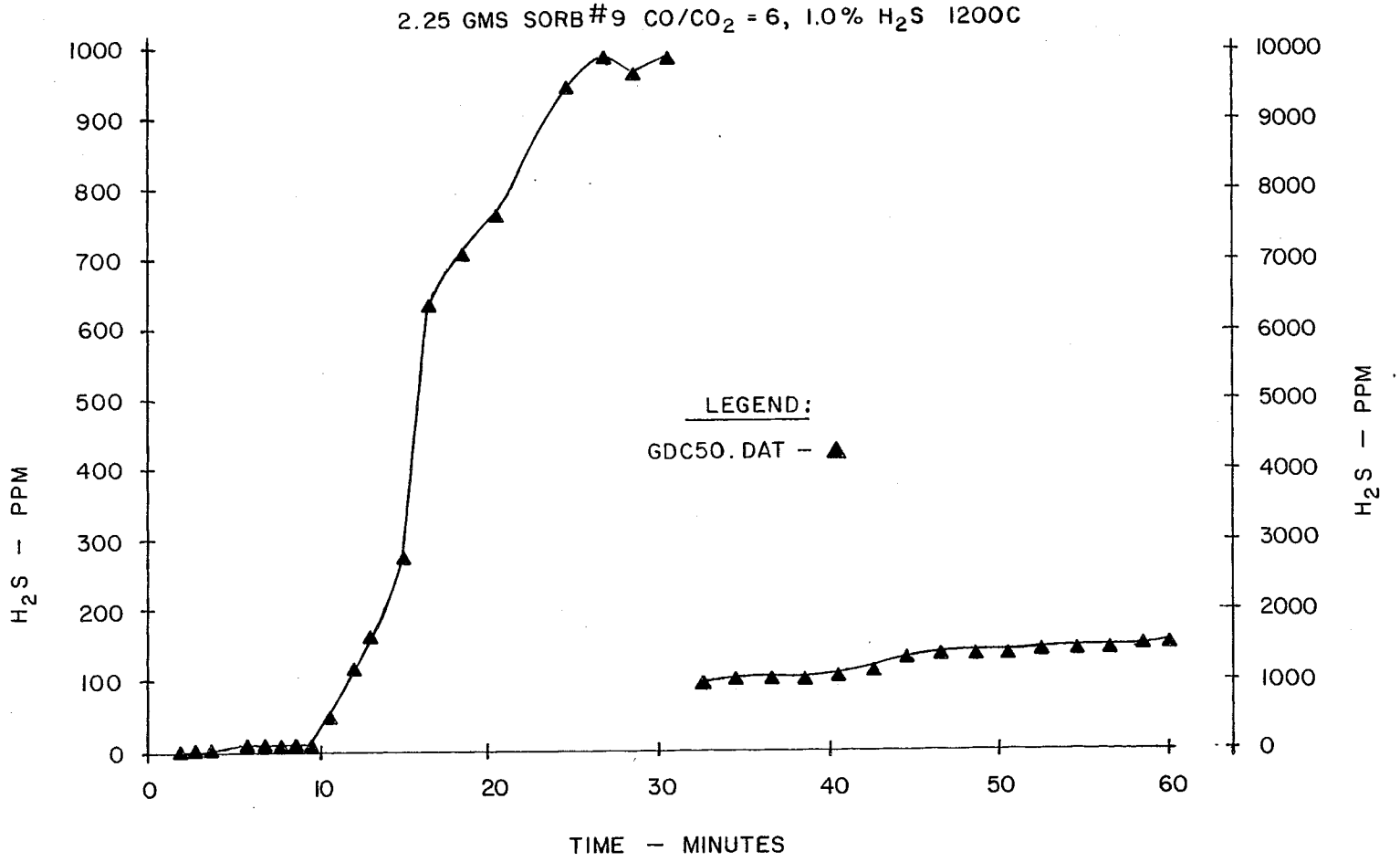

FIG. 15 is a plot of One Desulfurization Run with Sorbent #9 at 1200° C./2192° F. with $CO/CO_2=6$, 1% $H_2S$.

Figure 1:
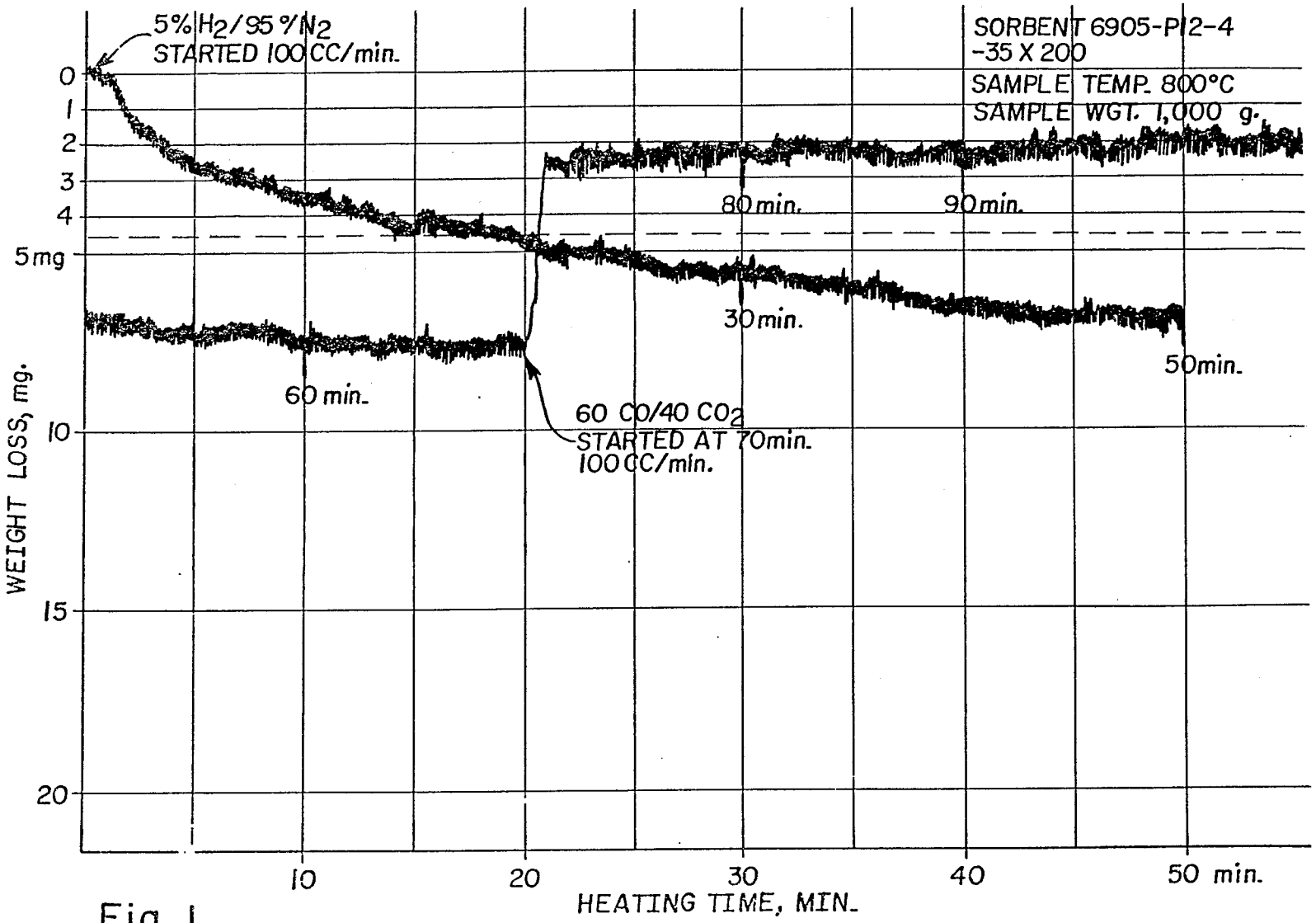
FIG. 1 is a plot of Thermo-Gravimetric Analysis of the Conditioning of Cerium Oxide.
Figure 2:
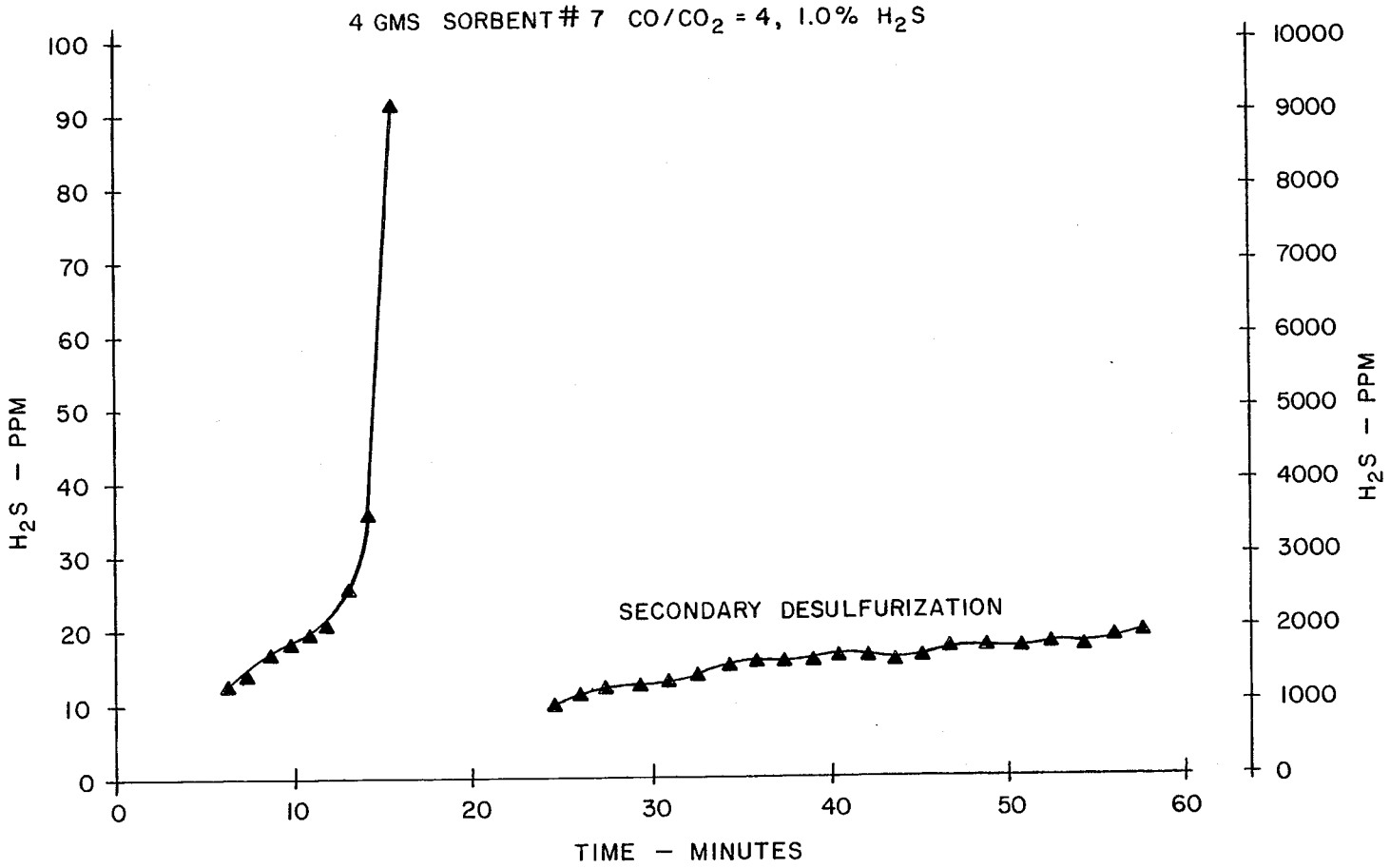
FIG. 2 is a plot of Breakthrough Curves for Cerium Oxide Desulfurization of Fuel Gas Containing 1.0% $H_2S$ at 1000° C./1832° F. Showing Primary and Secondary Desulfurization.

The information available from FIG. 1 may be used to explain the results obtained when desulfurizing fuel gases with cerium oxide. The standard procedure for each desulfurization run was to condition a column of $CeO_2$ one centimeter in diameter and six centimeters high (the reactor) with gases that were a mixture of 5% hydrogen with the remainder nitrogen for two hours prior to the beginning of the desulfurization run. The results of such a run are shown graphically in FIG. 2. For a period of about 13 minutes the sulfur content of the gases exiting the six centimeter high and one centimeter diameter column of cerium oxide contained less than 20 ppm of $H_2S$. The composition of the gas entering the reactor was: 33% $H_2$, 1% $H_2S$ and 66% CO and $CO_2$ where the ratio of $CO/CO_2$ is 6. From the data presented in FIG. 1 it can be seen that when a gas with a $CO/CO_2$ ratio of 1.5 is admitted to a reactor containing $CeO_{2-x}$, the number of reduction oxygen ion vacancies decreases rapidly. When the gas going into the reactor, containing the $H_2S$, encounters the $CeO_{2-x}$, the reaction that predominates is the removal of the sulfur from the gas according to equation (1). Since the removal of $H_2S$ from the gas is more rapid than the reaction of the oxygen in the gas with the reduction oxygen ion vacancies, the $H_2S$ content of the gas exiting the reactor is at less than 20 ppm level as indicated in FIG. 2. The desulfurization that occurs first to the very low levels will be referred to hereinafter as the "primary desulfurization". However, after the $H_2S$ content of the gas has been removed, the gas with a $CO/CO_2$ ratio of six now comes in contact with the $CeO_{2-x}$ upstream from the point of entry of the fuel gases into the reactor. This decreases the number of reduction oxygen ion vacancies in the sorbent just as was shown in FIG. 1 after the gas composition was changed from 5% $H_2$, remainder $N_2$ to $CO/CO_2$ with a ratio of 1.5 there was a decrease in the number of reduction oxygen ion vacancies. The number of reduction oxygen ion vacancies remaining has not been determined when $CeO_{1.92}$ is exposed to gases with a $CO/CO_2$ ratio of 6 used for this desulfurization experiment, but it should be materially 15 greater than the number in equilibrium with a $CO/CO_2$ ratio of 1.5. As a result there is further sulfur removal from the gases to a level of about 1500 ppm $H_2S$ for a period of at least 40 minutes because of the remaining reduction oxygen ion vacancies in the $CeO_{2-x}$. The desulfurization of the fuel gases that takes place when the composition of the sorbent has been changed so that it has fewer reduction oxygen ion vacancies will be called "secondary desulfurization" hereafter.

Figure 3:
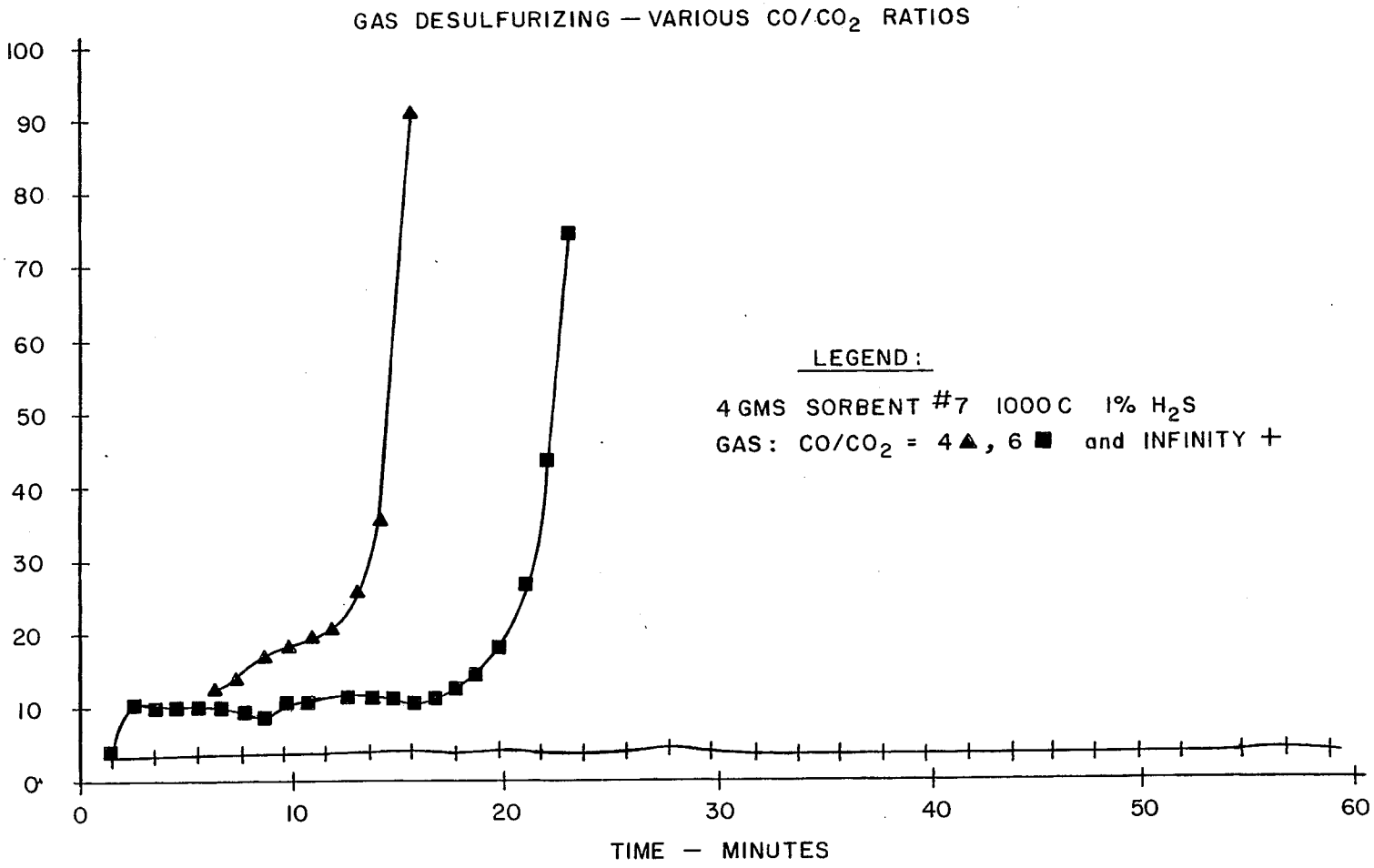
FIG. 3 is a plot of Breakthrough Curves for Primary Desulfurization of Fuel Gases with Three Different $CO/CO_2$ Ratios.

The effect of changes in gas composition on the length of time for primary desulfurization is shown in FIG. 3. Three curves are presented in the figure: the one with the triangular data points represents the desulfurization that may be obtained from a gas containing 33% $H_2$, 1% $H_2S$ and 66% $CO/CO_2$ with a ratio of 4; the one with square data points represents desulfurization that may be obtained with a gas containing 33% $H_2$, 1% $H_2S$ and 66% $CO/CO_2$ with a ratio of 6; and the one with the crosses represents desulfurization with a gas containing 33% $H_2$, 1% $H_2S$ and the remainder CO. All desulfurization runs were made at a temperature of 1000° C./1832° F. The length of time at low levels of $H_2S$ in the gases after primary desulfurization increases as the $CO/CO_2$ ratio increases. When there is no $CO_2$ in the gases being desulfurized, the desulfurization is to a level of 4 ppm of $H_2S$ from a starting value of 10000 ppm or 1% and continues for one hour. The desulfurization to the 4 ppm $H_2S$ level could have continued for a much longer time, but the experiment was ended arbitrarily at the end of one hour. The data presented herein indicates that the gas without any $CO_2$ continually "conditioned" the sorbent making it all capable of removing the $H_2S$ content from the fuel gas to the 4 ppm level.

This invention further relates to the method of increasing the reduction oxygen ion vacancies in lanthanide oxides whereby the lanthanide oxides exposed to fuel gases achieve increased utilization of the sorbent with gases exiting from the sorbent being sufficiently low in $H_2S$ to meet requirements for fuel for future requirements by increasing the "Quality Factor" (Quality Factor $=(\%\ CO+\%\ H_2O)/(\%\ CO_2+\%\ H_2O)$ which will hereinafter be written as "QF" of the gases being desulfurized.

EXAMPLE 4

Figure 4:
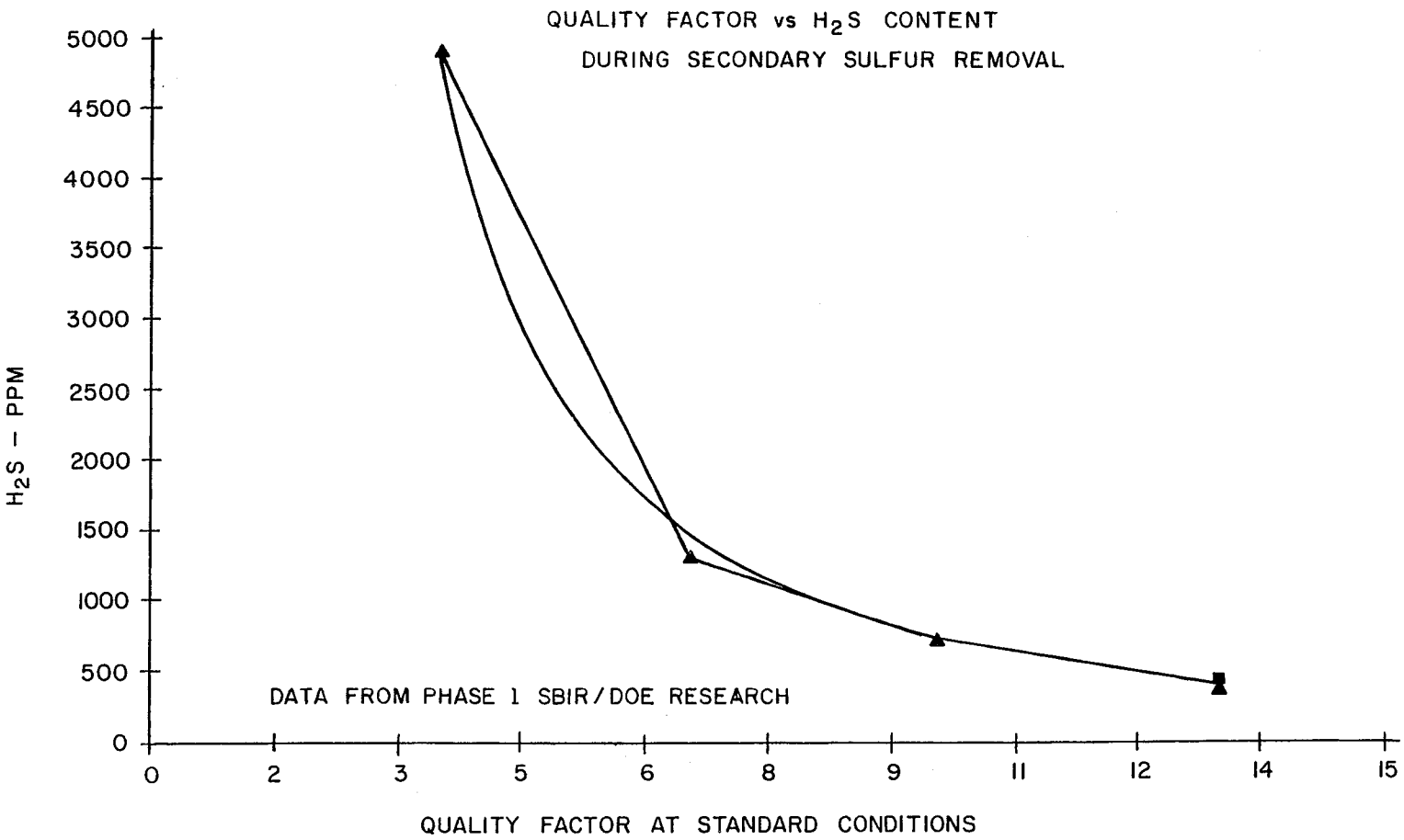
FIG. 4 is a plot of Extent of Secondary Desulfurization as a Function of the Quality Factor (QF=(% CO+% $H_2$)/(% $CO_2$+% $H_2$)) of Fuel Gases Being Desulfurized Containing 1% $H_2S$.

The results obtained under the SBIR/DOE contract showed that generally about one third of the $H_2S$ was removed from the gases during primary desulfurization and the remainder was removed during secondary desulfurization. As an example, when fuel gas with a $CO/CO_2$ ratio of six was desulfurized at 1000° C./1872° F. the sulfur level of the gases exiting the reactor was less the 20 ppm $H_2S$ during primary desulfurization but increased to an average level of about 1500 ppm $H_2S$ (see FIG. 2). It is not only necessary to increase the utilization of the sorbent, but to increase the utilization at low $H_2S$ levels of the gases being desulfurized necessary to meet the $H_2S$ requirements for fuels for future requirements. The average $H_2S$ content of the gases desulfurized at 1000° C./1872° F. during the secondary desulfurization have been plotted against the Quality Factor (QF) of the gas in FIG. 4. The QF for these gases has been computed from the composition of the gases at room temperature prior to their entry into the reactor where desulfurization occurred. The $CO/CO_2$ ratios of these gases and their QF are shown below.

| $CO/CO_2$ Ratio | Quality Factor |
|---|---|
| 2 | 3.49 |
| 4 | 6.51 |
| 6 | 9.51 |
| 6 | 12.99 |

The table directly above illustrates the superiority of the QF of fuel gases at room temperature compared to their $CO/CO_2$ ratios as a simple means of expressing the partial pressure of oxygen in such gases. The two gases whose $CO/CO_2$ ratios are six have significantly different QF because the gas with the QF of 9.51 contained 33% $H_2$, 57% CO and 9% $CO_2$ whereas the gas with the QF 12.99 contained 50% $N_2$, 33% $H_2$, 28.5% CO and 4.5% $CO_2$. The lower amount of $CO_2$ results in the partial pressure of oxygen in the gas with the higher QF being smaller. At any temperature, there is a good correlation between the QF and the partial pressure of oxygen in fuel gases.

As the QF increases, the $H_2S$ content of the gases exiting the reactor after secondary desulfurization decreases rapidly. The equation for the curved line going through the data points has been computed to be:

$$y=49072.96X^{-1.8696}.$$

The coefficient of determination of the equation with respect to the data points is 0.996.

Figure 5:
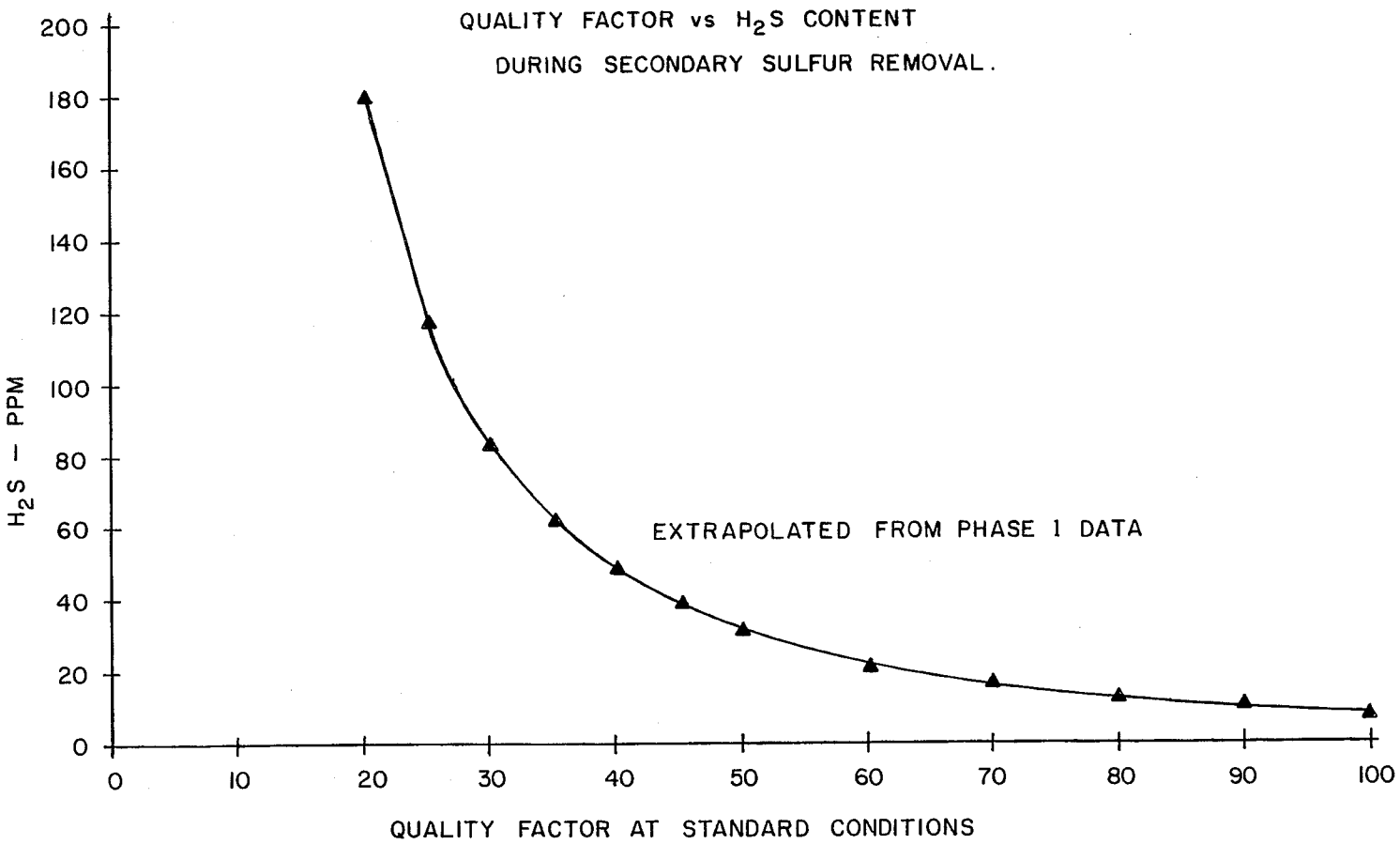
FIG. 5 is a plot of Extrapolation of the Information Contained in FIG. 4 to Higher QF Values Resulting in Lower Levels of Secondary Desulfurization.
Figure 6:
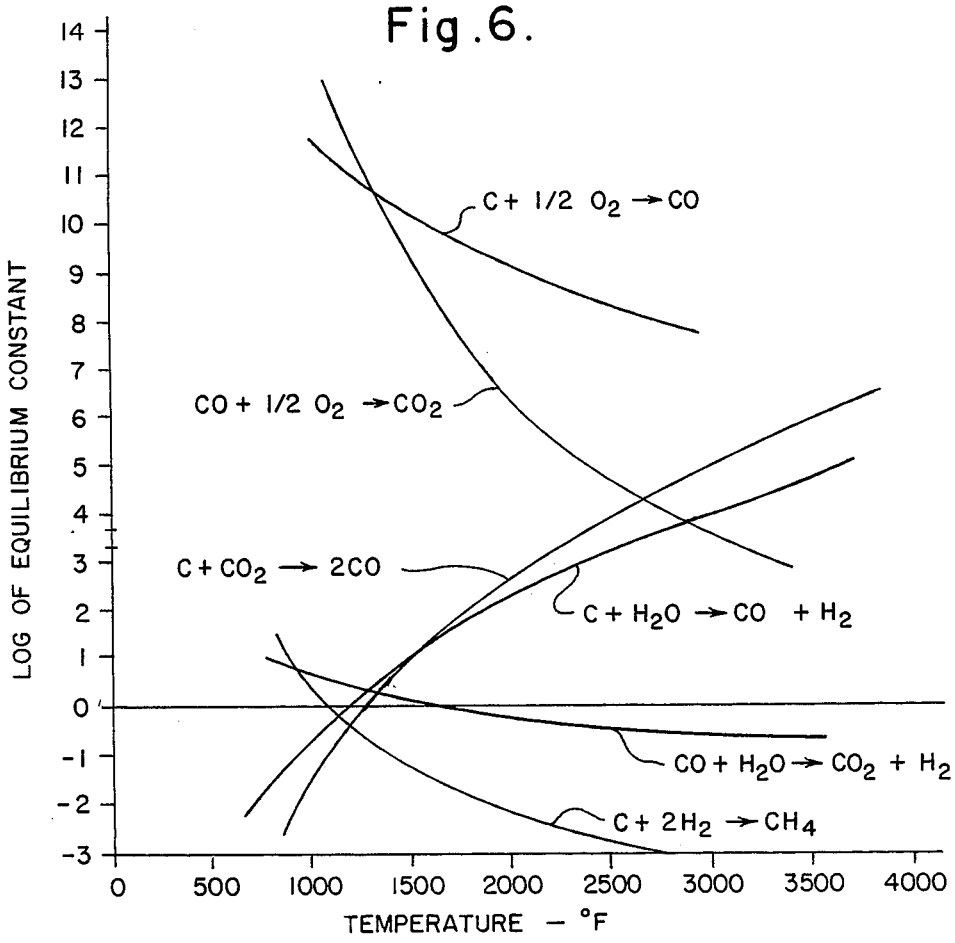
FIG. 6 is a plot of Gasification Reaction Equilibria.

The equation has been extrapolated to higher QF levels and that data has been plotted in FIG. 5. With the very porous granules used in the SBIR/DOE work, the calculations indicate that QF values of the fuel gas being desulfurized would have to be greater than 60 to achieve secondary desulfurization to 20 ppm of $H_2S$ or less.

However, if the sorbent contained additional doped oxygen ion vacancies as the result of additions of dopants, the QF necessary to achieve secondary desulfurization to the 20 ppm $H_2S$ level would be lower because it will be shown that the reduction oxygen ion vacancies are increased when the multivalent lanthanide oxide is doped.

This invention further relates to a method for increasing the QF of the fuel gases prior to their being exposed to the lanthanide oxides to retain the oxygen ion vacancies achieved with conditioning whereby the number of oxygen ion vacancies available in the sorbent during secondary desulfurization is increased thus decreasing the $H_2S$ content of the gases exiting the reactor and increasing the utilization of the lanthanide oxides.

The process of creating fuel gases from coal in a gasifier is complicated, and the times necessary for all of the reactions to come to equilibrium with the carbon in the gasifiers is never sufficient. Therefore, one method to increase the QF of the fuel gases would be to pass the gases through a bed of carbonaceous material outside the gasifier before the fuel gases are exposed to the lanthanide oxides for desulfurization. Calculations show that a QF of 179 can be achieved by such methods.

EXAMPLE 5

The following table shows the changes that would occur with one gas composition if exposed to carbon in this manner:

| | Before | After |
|---|---|---|
| Temperature | 1000° C. | 1000° C. |
| CO | 45.0% | 59.0% |
| $H_2$ | 30.0% | 39.4% |
| $H_2S$ | 1.10% | 0.93% |
| $H_2O$ | 9.5% | 0.298% |
| $CO_2$ | 9.0% | 0.249% |
| $CH_4$ | 4.5% | 0.146% |
| $pO_2$ | $3.14 \times 10^{-16}$ | $1.59 \times 10^{-19}$ |
| Volume | 1000 scf | 1214 scf |
| QF | 4.05 | 179.89 |
| Btu/scf | 288.93 | 321.27 |
| Total Btu | $2.88 \times 10^5$ | $3.90 \times 10^5$ |
| % Increase Btu (total) | | 35.4% |

This remarkable increase in QF, Btu value per standard cubic foot (scf) of gas and the increase in the total Btu content of the gas has been calculated to be achieved with the consumption of only 5.49 pounds of carbon if the column of carbon is long enough. The higher QF gas should be capable of desulfurization to less than 10 ppm of $H_2S$ with high utilization of the sorbent.

This invention further relates to the use of higher conditioning temperatures to increase the oxygen vacancies in cerium oxide (one of the lanthanide oxides) prior to its use for the desulfurization of fuel gases to increase the utilization of the cerium oxide.

Since it has been shown that the microporosity of the $CeO_{2-x}$ can have a pronounced effect on the number of reduction oxygen ion vacancies formed during conditioning, it is important to describe the technique for the preparation of the samples used to show the effect of temperature of conditioning on the number of oxygen vacancies formed. None of the methods of preparation of the cerium oxide described below will produce materials with the large surface area achieved during the work performed under the SBIR/DOE contract previously mentioned.

Method I. Commercial grade (99.9% purity) $CeO_2$ was used as a control standard for the reduction experiment as received from the supplier.

Method II. Doped $CeO_2$ was prepared by mechanically mixing the dopant and commercial grade $CeO_2$ using a mortar and pestle. Samples containing 5 and 10 mole percent of MgO and 5 and 10 percent CaO were prepared in this fashion.

Method III. Another type of sorbent was made by precipitating the cerium oxide. A standard reference sample of $CeO_2$ was prepared by dissolving $Ce(NO_3)_3.6H_2O$ in warm distilled water. The material was precipitated by adding ammonium oxalate. The precipitate was recovered by filtering the oxalate precipitate in a buchner funnel. The oxalate precipitate was dried on a hot plate for 24 hours and then calcined in a muffle furnace at 800° C. for 24 hours. The agglomerates of material were broken up using a mortar and pestle.

Method IV. Similar to the Method III, except 5 and 10 mole percent MgO and 5 and 10 mole percent CaO were added to the solution of cerium nitrate and were coprecipitated with the cerium oxalate thus creating the doped cerium oxide.

Method V. Five grams of each of the coprecipitate samples were pressed into pellets and sintered at 1500° C. for 6 hours to attempt to produce a set of samples consisting of a complete solid solution of $CeO_2$ and dopant. The pellets were crushed and ground using mortar and pestle.

Determination of the weight loss during conditioning from which the composition of the resulting cerium oxide could be determined (the basis for the calculation of the number of oxygen vacancies produced) were made using a Netzsch Geratbau Thermal Gravimetric Analyzer (TGA).

EXAMPLE 6

Samples prepared by Methods I and III were conditioned at 800° C./1472° F. and 1025° C./1847° F. in pure hydrogen.

| Temperature | Method Prep | III | I |
|---|---|---|---|
| 800° C. | Sample Weight (g) | 0.296 | 0.277 |
| | Weight Loss (mg) | — | 0.75 |
| | Composition | $CeO_2$ | $CeO_{1.97}$ |
| | Method Prep | III | I |
| 1000° C. | Sample Weight (g) | 0.296 | 0.277 |
| | Weight Loss (mg) | 3.63 | 4.00 |
| | Composition | $CeO_{1.87}$ | $CeO_{1.87}$ |

It is to be noted that the cerium oxide used in the SBIR/DOE contract had a composition of $CeO_{1.92}$ when conditioned at a temperature of 800° C./1472° F. with a gas containing 5% $H_2$, remainder nitrogen whereas the samples prepared according to the methods described directly above can be only marginally reduced with pure $H_2$ at 800° C. However, when the conditioning temperature is increased to 1000° C./1872° F. both the commercial $CeO_2$ and the precipitated $CeO_2$ show a reduction to $CeO_{1.87}$ emphasizing the powerful effect conditioning temperature has on the extent of conditioning and the formation of reduction oxygen ion vacancies in the cerium oxide.

It is also to be noted that exposure of the cerium oxide to an inert gas such as argon resulted in no weight loss of the pellets or formation of reduction oxygen ion vacancies.

Because of the method of preparation, the pellets produced by Meng and those produced by Method I should be very similar with respect to density and microporosity. The data above shows that there are very few reduction oxygen ion vacancies formed when such pellets are conditioned at 800° C./1472° F. for one hour. (Meng showed only minor change to $CeO_{2-x}$ when the pellets were exposed for three hours under these conditions.) The analogy has been proposed that moving anions of sulfur into lanthanide oxide with out oxygen ion vacancies is like trying to a get a checker into the center of a checkerboard that has all the squares filled. Meng achieved no utilization when desulfurizing simulated fuel gas with cerium oxide when the pellets were conditioned for two to three hours using the conditioning gas and temperatures mentioned directly above. The minimal change from $CeO_2$ to $CeO_{2-x}$ indicates there were very few oxygen ion vacancies in the Meng pellets with three hours of conditioning. The results obtained under the SBIR/DOE contract indicates that conditioning of pellets with high levels of microporosity creates reduction oxygen ion vacancies which promotes high utilization of the lanthanide oxide sorbent for desulfurization of fuel gases.

EXAMPLE 7

The effect of temperature on the composition of the cerium oxide formed by conditioning at various temperatures is shown in the following table.

| Method of Material Production Temperature | III Composition |
|---|---|
| 800° C. | $CeO_2$ |
| 920° C. | $CeO_{1.91}$ |
| 1010° C. | $CeO_{1.87}$ |
| 1110° C. | $CeO_{1.85}$ |

The data presented in FIG. 1 shows that if the $CeO_2$ was porous on a microscopic basis that $CeO_{1.92}$ could be achieved by conditioning at 800° C. Therefore the composition of the cerium oxide after conditioning will be a function of the original microporosity, and the temperature of conditioning. The conditioning gases used have been hydrogen and mixtures of hydrogen and nitrogen. When the reduction of the cerium oxide occurs, there is the formation of some water. It would not be possible to calculate the partial pressure of oxygen in such gases without precise information on the amount of water formed by the reduction. However, if the partial pressure of oxygen could be determined, the composition of the cerium oxide resulting could be estimated from the cerium-oxygen phase diagram of Bevan and Kordis.

This invention further relates to the use of multivalent lanthanide oxides which have been doped with magnesium oxide to increase the number of oxygen ion vacancies achieved with conditioning thereby increasing the utilization of the lanthanide oxides when reacting with fuel gases to meet the specifications for future requirements for fuel gases, and furthermore, such doped sorbents retain most of the reduction oxygen ion vacancies even after being sintered at high temperature.

EXAMPLE 8

The effect of doping and sintering on the composition of the cerium oxide formed after conditioning is shown in the following table.

| Method of Preparation | I | II | V |
|---|---|---|---|
| Dopant | | 10 Mole % MgO | |
| Temperature | | 1025° C. | |
| Sample Weight (grams) | 0.280 | 0.312 | 0.677 |
| Weight Loss (mg) | 3.500 | 5.000 | 9.500 |
| Composition | $CeO_{1.86}$ | $CeO_{1.82}$ | $CeO_{1.86}$ |

Information available on the effect of dopants indicates that magnesium oxide is a very poor dopant. Furthermore, the method of preparation of the doped cerium oxide was unlikely to provide a homogenous product with the much of the magnesium oxide in solution in the cerium oxide crystals. Never the less, the doping has increased the reduction oxygen ion vacancies. It has been stated previously that the doped oxygen ion vacancies are created n the crystal when the crystals are formed, but these doped oxygen ion vacancies appear to have been instrumental in increasing the reduction oxygen ion vacancies achieved with conditioning. It is expected that as the doping procedures are improved that the doped oxygen ion vacancies in the crystal will further increase the number of reduction oxygen ion vacancies achieved with conditioning.

Work conducted under the SBIR/DOE contract showed that there was a very sharp reduction in surface area and porosity as the sorbents were sintered to achieve sufficient strength to with stand repeated cycles of sulfidation and regeneration. The pellets prepared under the contract were sintered at a maximum temperature of 1250° C./2282° F. whereas the pellets produced by Method V were sintered at 1500° C./2732° F. It is expected that there would be a severe reduction in microporosity with such a high sintering temperature. However, the doped oxygen ion vacancies and the remaining microporosity have compensated for the reduction in microporosity due to the high sintering temperatures.

It is important to be able to sinter at high temperatures to insure that the pellets produced have enough strength to withstand multiple cycles of sulfidation and regeneration and still retain large numbers of oxygen vacancies.

This invention further relates to the use of lanthanide oxides to which dopants have been added in sufficient quantity to produce the maximum number of oxygen ion vacancies which enhances the ability of the doped sorbent to achieve high utilization and low levels of $H_2S$ for both primary and secondary desulfurization in the fuel gas being desulfurized.

It has been determined that the maximum conductivity in electrolytic cells of lanthanide oxides is at a maximum when either the alkaline earth element oxide or the lanthanide oxide or combinations of the same are more than 7 mole percent and less than 15 mole percent of the lanthanide oxide being doped. If the total mole percent of the dopant is greater than 15 mole percent of the lanthanide oxide being doped, the conductivity will be increased as compared to undoped lanthanide oxide, but the conductivity will not be at the maximum. The number of doped oxygen ion vacancies is fixed by the amount of the dopant used. However, for the same mole percent of dopants, one of which has an ionic radius the same as the element being doped and the other having an ionic radius quite different from the element being doped, there can be differences in conductivity of the doped material. It is expected that the conditions that maximize conductivity of lanthanides will also influence the effect of doped oxygen ion vacancies on the formation of reduction oxygen ion vacancies thereby enhancing the ability of the lanthanide oxides to desulfurize fuel gases with high utilization of the sorbent.

It has been determined that maximum conductivity in cerium oxide solid electrolytes is achieved when they are doped with gadolinium oxide. However, lanthanum oxide is almost as good as gadolinium oxide in this respect. Since lanthanum is much more abundant than gadolinium (correspondingly less expensive) lanthanum would be preferred.

Lanthanum oxide achieves maximum conductivity when doped with either barium or strontium oxide. Because of the toxicity of barium compounds, strontium would be the preferred dopant of the alkaline earth element oxides.

This invention further relates to the method whereby the lanthanide oxides used for the desulfurization of fuel gases to $H_2S$ levels sufficient to permit their use for future fuel gas requirements are produced with a high degree of microporosity whereby the total number of oxygen ion vacancies may be increased to increase the utilization of the lanthanide oxides when exposed to such fuel gases.

It has been found that the multivalent lanthanide oxide crystals which contain small but significant quantities of oxides of the alkaline earth elements or small but significant quantities of other lanthanide oxides so that doped oxygen ion vacancies are formed can be produced with high levels of microporosity by:

(a) using solutions of a polyfunctional organic acids possessing at least one hydroxy and one carboxylic function such as citric, malic, tartaric, glycollic, or lactic acid;

(b) mixing the solutions of the metallic salts of the lanthanides and the alkaline earth elements such as nitrates, acetates, oxalates and ammonia salts of the metallic ions with the polyfunctional organic acid solution;

(c) dehydrating the mixed solutions of the polyfunctional organic acids and the solutions of the metallic salts of the lanthanides and alkali earth elements rapidly in a revolving evaporator under a pressure of a few mm of mercury at 70° C. until the viscosity becomes a few thousand centipoise but not so viscous as to prevent the discharge of the solutions from the vessel;

(d) completing dehydration of the solutions in a drying oven under vacuum for 3 to 24 hours at a temperature below 100° C. resulting in the formation of transparent glasses or solid foams of the lanthanide salts containing small but significant amounts of the salts of the alkali earth elements in a homogenous mixture which is completely amorphous;

(e) pyrolyzing the transparent glasses or solid foams at a temperature near 600° C./1112° F. under air or oxygen to form perfectly homogenous crystals of the mixtures of the oxides of the lanthanides and alkali earth elements;

(f) sintering the pyrolized oxide mixtures at a temperature high enough to provide sufficient crush strength to permit the oxides so formed to be used for repeated cycles of sulfidation and regeneration of the mixed oxides.

This invention further relates to use of lanthanide oxide for the desulfurization of fuel gas whereby the utilization of the lanthanide oxides is increased for the reduction of the $H_2S$ content of the fuel gases to levels sufficiently low to permit such gases to be used for future fuel requirements comprising the steps of:

(a) producing the doped lanthanide oxides with high levels of microporosity;

(b) controlling the amount of dopant to a maximum of 15 mole percent and more favorably to a maximum of 10 mole percent;

(c) conditioning the doped lanthanide oxides at a temperature of at least 950° C./1712° F. but preferably of at least 1025° C./1877° F. with a reducing gas;

(d) increasing the Quality Factor of the gas being desulfurized to as high a level as possible by passing the fuel gas from the gasifier over a fixed bed of carbon prior to exposing it to the doped lanthanides for desulfurization.

It has been determined that there is no one simple thing that can be done to increase the utilization of lanthanide oxides for the desulfurization of fuel gases to low concentrations of $H_2S$ (less than 100 ppm of $H_2S$). In reducing this invention to practice is has been determined that the total number of oxygen ion vacancies is increased by increasing:

1. the amount of microporosity in the lanthanide oxide crystals;

2. increasing the conditioning temperature;

3. using less than 15 mole percent of the dopant and preferably 7 to 10 mole percent of the dopant;

4. increasing the QF of the gas used for conditioning;

5. increasing the QF of the gas being desulfurized.

It is not likely that all five of these factors affecting the extent of desulfurization and utilization would have to be optimized for each application, but understanding all of the factors makes it possible to make the adjustments to the process to achieve the desired level of desulfurization at minimum cost. For example, the method of production of the pellets or granules for desulfurization produces the greatest amount of microporosity when the sintering temperature is low. However, low sintering temperatures do not provide the crush strength necessary to permit the repeated cycles of sulfidation and regeneration necessary to reduce the cost of desulfurization with lanthanide oxides. Therefore, it is likely that one or more than one of the other factors affecting fuel gas desulfurization with lanthanides will require compensating adjustments be made to achieve the level of desulfurization desired with adequate utilization of the sorbent for fuel gases to meet future requirements for such gases.

This invention further relates to the use of cerium oxide for the desulfurization of fuel gases for future requirements for fuel gases.

There are several reasons for the choice of cerium of fuel gas desulfurization:

1. Cerium is the most abundant of the lanthanide oxides and therefore it is expected that its cost should be lower than for any of the others;

2. Of the four elements of the lanthanide group in greatest abundance (cerium, lanthanum, neodymium and praseodymium), only cerium can exist either in the valence three and four stages; or as $Ce^{+4}O_2$ or $Ce^{+3}O_{1.5}$. It is the process of reducing the $CeO_2$ toward $CeO_{1.714}$ that provides many of the reduction oxygen ion vacancies necessary for high utilization of the cerium oxide when used to desulfurize fuel gases;

3. Cerium oxide has been shown to be capable of reducing the concentration of $H_2S$ in fuel gases from 10000 to 4 ppm;

4. In order for any gas desulfurization process to succeed, it is necessary that the sorbent be regenerable; and it has been determined during the SBIR/DOE contract that cerium oxide could be sulfided and regenerated over six cycles with almost no loss in its ability to desulfurize fuel gases.

This invention further relates to the methods of increasing the oxygen ion vacancies in solutions of lanthanide compounds that may be applicable to the production of superconductors.

Superconductivity in lanthanide based materials is due to oxygen vacancies in their crystal structure. At the present time superconductors based on lanthanides do contain alkali metal oxides as dopants, but their processing may not include such steps as conditioning with high QF gases which has been shown to materially increase the oxygen vacancies in cerium oxide.

Various embodiments and modifications of this invention have been described in the foregoing description and examples, and further modifications will be apparent to those skilled in the art. Such modifications are included within the scope of the invention as defined by the following claims.

We claim:

1. A method for the desulfurization of fuel gases resulting from the incomplete combustion of sulfur containing hydrocarbons comprising the steps of:

(a) creating oxygen ion vacancies in a lanthanide oxide; and (b) reacting the fuel gases with the lanthanide oxide containing the oxygen ion vacancies whereby the amount of sulfur in the gases is reduced.

2. The method of claim 1 wherein the reaction of the fuel gases with the lanthanide oxide forms lanthanide oxysulfide.

3. The method of claim 1 wherein the oxygen ion vacancies are created in the lanthanide oxygen by doping the lanthanide oxide with small but significant quantities of at least one of an alkaline earth element oxide, another lanthanide oxide and combinations of each.

4. The method of claim 1 wherein the lanthanide oxide is cerium oxide.

5. The method of claim 1 wherein the lanthanide oxide is lanthanum oxide.

6. The method of claim 1 wherein the oxygen ion vacancies are created in the lanthanide oxide by conditioning at a conditioning temperature the lanthanide oxide with gases consisting mainly of hydrogen, carbon monoxide and combinations of the same.

7. The method of claim 6 wherein the number of oxygen ion vacancies formed during conditioning is increased by raising the conditioning temperature.

8. The method of claim 6 wherein the conditioning gases are diluted with inert gases such as nitrogen, argon and helium.

9. The method of claim 6 wherein the quality factor ($QF=(\%\ CO+\%\ H_2)/(\%\ CO_2+\%\ H_2O)$) of the conditioning gases is preferably greater than 20.

10. The method of claim 6 wherein the conditioning temperature is raised, thereby increasing the utilization of the lanthanide oxide for the desulfurization of fuel gases.

11. The method of claim 7 or 10 wherein the condition temperature is raised to at least 900°.

12. The method of claim 6 wherein the number of oxygen ion vacancies created by the conditioning of the lanthanide oxide range up to $1\times10^{21}$ oxygen ion vacancies per gram of lanthanide oxide.

13. The method of claim 3 wherein the oxygen ion vacancies created by doping facilitate the formation of reduction oxygen ion vacancies formed during conditioning.

14. The method of claim 3 wherein the lanthanide oxide is one component of solid solution comprising one multi-valent lanthanide oxide up to 99.95 mole percent of the total; and one alkaline earth element oxide form 0.05 to 15 mole percent of the total.

15. The method of claim 3 wherein the lanthanide oxide is one component of a solid solution comprising cerium oxide up to 99.95 mole percent of the total, and one of the other lanthanide oxides from 0.05 to 15 mole percent of the total.

16. The method of claim 3 wherein said one of the alkaline earth element oxides is strontium oxide.

17. The method of claim 15 wherein said one of the other lanthanide oxides is lanthanum oxide.

18. The method of claim 3 wherein said one of the combination of alkaline earth element oxides and multivalent lanthanide oxides is a combination of strontium oxide and lanthanum oxide.

* * * * *

UNITED STATES PATENT AND TRADEMARK OFFICE

CERTIFICATE OF CORRECTION

PATENT NO. : 4,885,145

DATED : December 5, 1989

INVENTOR(S) : D. ALAN R. KAY, WILLIAM G. WILSON

It is certified that error appears in the above-identified patent and that said Letters Patent is hereby corrected as shown below:

Column 5, line 38, change "1724" to --1.724--

Column 9, line 7, delete "15".

Column 13, line 59, change "n" to --in--.

Signed and Sealed this

Twenty-sixth Day of November, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,885,145

DATED : December 5, 1989

INVENTOR(S) : D. ALAN R. KAY, WILLIAM G. WILSON

It is certified that error appears in the above-identified patent and that said Letters Patent is hereby corrected as shown below:

Column 4, line 59, delete "desulfurization of fuel gases".

Signed and Sealed this

Eighth Day of September, 1992

*Attest:*

DOUGLAS B. COMER

*Attesting Officer*

*Acting Commissioner of Patents and Trademarks*